US007575306B2

(12) United States Patent
Kodama

(10) Patent No.: US 7,575,306 B2
(45) Date of Patent: Aug. 18, 2009

(54) DISCHARGE HEAD, METHOD OF MANUFACTURING DISCHARGE HEAD, AND LIQUID DISCHARGE APPARATUS

(75) Inventor: Kenichi Kodama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 364 days.

(21) Appl. No.: 11/091,547

(22) Filed: Mar. 29, 2005

(65) Prior Publication Data

US 2005/0219328 A1 Oct. 6, 2005

(30) Foreign Application Priority Data

Mar. 30, 2004 (JP) ..... 2004-100903

(51) Int. Cl.
*B41J 2/045* (2006.01)
*B41J 29/38* (2006.01)

(52) U.S. Cl. ..... 347/70; 347/10

(58) Field of Classification Search ..... 347/68–72, 347/7, 10, 11
See application file for complete search history.

(56) References Cited

U.S. PATENT DOCUMENTS 5,530,465 A * 6/1996 Hasegawa et al. ..... 347/70
5,767,612 A * 6/1998 Takeuchi et al. ..... 310/324
6,092,886 A * 7/2000 Hosono ..... 347/10
6,312,077 B1 * 11/2001 Araki ..... 347/11

FOREIGN PATENT DOCUMENTS

| | | | |
|---|---|---|---|
| JP | 10-119262 | A | 5/1998 |
| JP | 10-151179 | A | 6/1998 |
| JP | 10-151739 | A | 6/1998 |
| JP | 10-217466 | A | 8/1998 |
| JP | 2001-58401 | A | 3/2001 |
| JP | 2003-136715 | A | 5/2003 |

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The discharge head comprises: a liquid chamber which accommodates a liquid to be discharged from a discharge hole onto a discharge receiving medium; a piezoelectric body which applies a discharge pressure to the liquid inside the liquid chamber; a thin film member which includes a first electrode provided at least on a surface of the piezoelectric body on a side facing the liquid chamber; a second electrode which is provided on a surface of the piezoelectric body on a side opposite to the liquid chamber; and a holding plate which is bonded to a surface of the second electrode on a side opposite to the piezoelectric body, wherein a thickness of the thin film member is less than a sum of a thickness of the second electrode and a thickness of the holding plate.

3 Claims, 20 Drawing Sheets

DISCHARGE HEAD, METHOD OF MANUFACTURING DISCHARGE HEAD, AND LIQUID DISCHARGE APPARATUS

BACKGROUND OF THE INVENTION

1. Field of the Invention

The present invention relates to a discharge head, a method of manufacturing a discharge head, and a liquid discharge apparatus, and more particularly to a structure and manufacturing technology for a discharge head that is suitable for discharging liquid of high viscosity and achieving high-speed discharge.

2. Description of the Related Art

In recent years, inkjet printers have come to be used widely as data output apparatuses for outputting images, documents, or the like. By driving recording elements, such as nozzles, provided in a recording head in accordance with data, an inkjet printer is able to form data onto a recording medium, such as recording paper, by means of ink discharged from the nozzles.

In an inkjet printer, a desired image is formed on a recording medium by causing a recording head having a plurality of nozzles and a recording medium to move relative to each other, while causing ink droplets to be discharged from the nozzles.

In an inkjet recording apparatus, actuators made of lead zirconate titanate (PZT) piezoelectric elements, or the like, are provided as ink discharge pressure application devices for discharging ink droplets from the print head. By deforming the liquid chambers (pressure chambers) containing the ink to be discharged, by driving the actuators, a pressure is applied to the ink inside the liquid chambers.

The ink has a property whereby the ink solvent evaporates and the viscosity of the ink increases when it is in contact with air. Therefore, in an inkjet recording apparatus based on the system described above, if a nozzle does not perform ink discharge for a prescribed period of time, the ink inside the nozzle may increase in viscosity, it may become impossible to discharge droplets at the prescribed discharge frequency, and discharge abnormalities may arise, such as discharge failures in which no ink droplet is discharged, even if a prescribed discharge pressure is applied.

In general, in order to discharge ink of high viscosity (high-viscosity liquid), a higher pressure (discharge pressure) should be applied when discharging the ink, in comparison to the prescribed discharge pressure. However, there are limitations on the pressure which can be applied to the ink, due to the characteristics of the actuators and the shape of the liquid chambers. Furthermore, since the ink flow velocity is slower in high-viscosity liquid that in ink having a low viscosity, there is a tendency for the time required for refilling (the replenishment time) to increase, and hence it is difficult to increase the droplet ejection (discharge) frequency.

Various factors, such as the structure and shape of the actuators and the structure and shape of the liquid chambers, can be devised in order to achieve satisfactory discharge of high-viscosity liquid of this kind.

On the other hand, demands for increased printing speed are met by raising the droplet ejection frequency of the print head by modifying the drive waveform of the actuators, as well as modifying the structure and control of the print head, and the composition of the conveyance device and the conveyance control used for same.

In the inkjet head described in Japanese Patent Application Publication No. 2001-58401, a portion of the wall of a liquid chamber is formed by a diaphragm, and a piezoelectric element including a lower electrode, a piezoelectric film and an upper electrode is provided on the diaphragm. The shape and size of the liquid chamber, the thickness of the diaphragm, and the thickness of the piezoelectric film are all optimized, for instance, the piezoelectric film is formed to a greater thickness than the diaphragm, in such a manner that freedom of design can be increased without causing fluctuations in the spraying characteristics.

Furthermore, in the inkjet head described in Japanese Patent Application Publication No. 10-217466, a diaphragm is provided on the upper surface of the liquid chamber, and a lower electrode, a piezoelectric element and an upper electrode are provided, in this order from the bottom upward, on top of the diaphragm, in such a manner that the piezoelectric element is sandwiched between the upper electrode and the lower electrode. Since the width of the shorter edge of the lower electrode is smaller than the width of the shorter edge of the diaphragm, and the width of the longer edge of the lower electrode is greater than the width of the longer edge of the diaphragm, the displacement of the diaphragm is increased and it becomes possible to increase the volume of the discharged ink droplet.

However, the actuators, such as piezo-type piezoelectric elements, may be restricted by the design of the print head, namely, the size, shape and structure of the actuators are determined by the size of the print head, the number of liquid chambers provided in the print head (in other words, the nozzle density), and the like. Furthermore, if a special shape or structure is adopted for the liquid chambers, then the manufacturing steps become complicated and increase in number, and this may lead to increased manufacturing costs and reduced production yield.

In the inkjet head described in Japanese Patent Application Publication No. 2001-58401, the dimensional relationships in the region forming the inkjet head are optimized in such a manner that it is possible to achieve a compact, high-density head that is difficult to manufacture conventionally, as well as improving performance characteristics and achieving greater stability in the manufacturing process. However, there is no disclosure regarding a satisfactory method for controlling an inkjet head having a structure of this kind.

Furthermore, in the inkjet head described in Japanese Patent Application Publication No. 10-217466, the displacement of the diaphragm, and hence the ink discharge volume, is increased by optimizing the sizes of the diaphragms and the piezoelectric elements. However, there is no disclosure regarding the control of the piezoelectric elements, and there is no disclosure regarding issues relating to discharge of high-viscosity liquid or high-speed droplet ejection.

SUMMARY OF THE INVENTION

The present invention has been contrived in view of such circumstances, and an object thereof is to provide a discharge head, a method of manufacturing a discharge head and a liquid discharge apparatus, whereby satisfactory discharge of high-viscosity liquid and high-speed droplet ejection are achieved, and a discharge head can be manufactured without requiring complicated manufacturing steps.

In order to attain the aforementioned object, the present invention is directed to a discharge head, comprising: a liquid chamber which accommodates a liquid to be discharged from a discharge hole onto a discharge receiving medium; a piezoelectric body which applies a discharge pressure to the liquid inside the liquid chamber; a thin film member which includes a first electrode provided at least on a surface of the piezoelectric body on a side facing the liquid chamber; a second electrode which is provided on a surface of the piezoelectric body on a side opposite to the liquid chamber; and a holding plate which is bonded to a surface of the second electrode on a side opposite to the piezoelectric body, wherein a thickness of the thin film member is less than a sum of a thickness of the second electrode and a thickness of the holding plate.

More specifically, a thin film member comprising a first electrode (liquid chamber side electrode) is provided on a piezoelectric body which applies a discharge pressure to the liquid inside the liquid chamber, on at least the surface of the piezoelectric body on the liquid chamber side, and a second electrode (diaphragm side electrode) and a holding plate (diaphragm) are provided on the surface of the piezoelectric body on the opposite side to the liquid chamber. The total of the thickness of the thin film members, d1, is less than the total of the thickness of the second electrode and the thickness of the holding plate, d2. Therefore, if a prescribed voltage is applied between the first electrode and the second electrode, the holding plate deforms in such a manner that the volume of the liquid chamber is increased, and since the direction of the force that deforms the holding plate when a drive voltage acts on the piezoelectric body in order to discharge liquid is the same as the direction of the restoring force which seeks to return the deformed holding plate to its original state, the speed of deformation of the holding plate is increased, and it becomes possible to discharge high-viscosity liquid, as well as being able to discharge liquid at high-speed.

In other words, the relationship between the thickness of the thin film member, d1, and the combined thickness of the second electrode and the holding plate, d2, is expressed by d1<d2.

Either one of the first electrode or the second electrode functions as an individual electrode which is applied with a drive electrode (drive signal) for driving the piezoelectric body, and the other electrode functions as a common electrode which forms a standard potential of the drive voltage.

The thin film member provided on the surface of the piezoelectric body on the liquid chamber side may consist of a first electrode, or it may comprise a first electrode and a holding member which holds the first electrode. Furthermore, the holding member may include an insulating member which ensures the insulation of the portion of the holding member that makes contact with the liquid inside the liquid chamber.

Desirably, if the thin film member consists of a first electrode, then insulation processing is carried out as necessary in at least the portion of the electrode that makes contact with the liquid inside the liquid chamber.

On the other hand, the holding plate bonded to the second electrode functions as a diaphragm (pressurization plate) which deforms in a prescribed direction in accordance with the distortion of the piezoelectric body.

The discharge head may be a full line type discharge head in which discharge holes for discharging liquid droplets are arranged through a length corresponding to the entire width of the discharge receiving medium, or a serial type discharge head (shuttle scanning type discharge head) in which a short head having discharge holes for discharging liquid droplets arranged through a length that is shorter than the entire width of the recording medium discharges liquid droplets onto the discharge receiving medium while scanning in the breadthways direction of the discharge receiving medium.

A full line discharge head may be formed to a length corresponding to the full width of the recording medium by combining short heads having rows of discharge holes which do not reach a length corresponding to the full width of the recording medium, these short heads being joined together in a staggered matrix fashion.

Moreover, "discharge receiving medium" indicates a medium onto which ink droplets are discharged from a discharge head, and this term includes various types of media, irrespective of material and size, such as continuous paper, cut paper, sealed paper or other types of paper, resin sheets, such as OHP sheets, film, cloth, and other materials. The discharge receiving medium may also be called a recording medium, liquid receiving medium, or discharge (recording) medium.

A ceramic piezoelectric element, such as lead zirconate titanate (PZT), barium titanate, or the like, can be used for the piezoelectric body.

The volume of the liquid chamber accommodating the liquid to be discharged changes with the deformation of at least one wall of the chamber, and hence the liquid chamber functions as a pressure chamber which discharges liquid of an amount corresponding to the change in volume. The liquid chamber is connected to liquid discharge holes via tubes (liquid flow channels), restrictors, and the like.

Preferably, the piezoelectric body comprises a piezoelectric body which acts in a $d_{31}$ mode displacement direction.

In other words, if a piezoelectric body which acts in the $d_{31}$ mode displacement direction is used, in such a manner that the piezoelectric body generates distortion in a direction substantially perpendicular to the direction of the electrical field created by the voltage applied between the first electrode and the second electrode, then it is possible to cause the holding plate to deform in a direction which increases the volume of the liquid chamber (and a direction which reduces the volume of the liquid chamber).

For example, by providing a first electrode and a second electrode respectively on one surface of the piezoelectric body and the opposite surface to this surface, when an electrical field is generated in the thickness direction of the piezoelectric body, the piezoelectric body distorts in a direction substantially perpendicular to the electrical field (in other words, in the lateral direction). Consequently, the holding plate formed on the first electrode is caused to deform in a direction substantially parallel to the electrical field applied to the piezoelectric body.

Preferably, an absolute value of a discharge voltage applied between the first electrode and the second electrode when the liquid accommodated in the liquid chamber is discharged by driving the piezoelectric body is less than an absolute value of a securing voltage applied between the first electrode and the second electrode when the holding plate is secured in position during non-discharge of the liquid accommodated in the liquid chamber.

In other words, in the discharge head according to the present invention, if the drive voltage applied to the piezoelectric body when liquid is to be discharged is smaller than the absolute value of the securing voltage applied when the holding plate is secured in position during non-discharge, then the piezoelectric body is distorted in the prescribed direction when the drive voltage is applied, and hence the holding plate bonded to the first electrode is caused to deform in the prescribed direction.

If the application voltage for driving the piezoelectric body (the discharge voltage) is applied to the negative polarity side of the piezoelectric body, then a positive voltage is applied, and if it is applied to the positive polarity side of the piezoelectric body, then a negative voltage is applied.

The discharge voltage and the securing voltage are applied by a voltage application device. In the voltage application device, the drive voltage and the securing voltage are applied to the piezoelectric body in accordance with a control signal supplied by the control device which controls discharge from the discharge head. The voltage application device may be installed inside the discharge head, or it may be provided externally.

The holding plate bonded to the first electrode functions as a diaphragm (pressurization plate) which is deformed by the distortion of the piezoelectric body.

Preferably, an absolute value of a pull-in voltage applied between the first electrode and the second electrode when driving the piezoelectric body so as to cause the holding plate to deform toward an outside of the liquid chamber is greater than the absolute value of the securing voltage.

More specifically, if a voltage having a higher absolute value than the absolute value of the securing voltage which secures the holding plate is applied to the piezoelectric body during non-discharge, then the holding plate deforms toward the outer side of the liquid chamber so as to increase the volume of the liquid chamber.

In other words, taking Va to be the applied voltage for securing the holding plate in position during non-discharge, taking Vb to be the applied voltage during a pull operation for deforming the holding plate toward the outside of the liquid chamber so as to increase the volume of the liquid chamber in order to pull the boundary surface of the liquid (the meniscus surface) inside the discharge hole, into the liquid chamber, prior to a discharge operation, and taking Vc to be the applied voltage when discharging a liquid droplet (the applied voltage during a push operation), then the following relationship is established between Va, Vb and Vc: $|Vc|<|Va|<|Vb|$.

Preferably, when no voltage is applied between the first electrode and the second electrode, the holding plate is curved in a protruding shape toward an inside of the liquid chamber.

In other words, by bending the holding plate in such a manner that it protrudes into the liquid chamber, the direction of deformation of the holding plate is always the same direction. Therefore, the responsiveness of the holding plate is improved and variation in discharge characteristics between discharge holes can be suppressed. Furthermore, it is also possible to lower the drive voltage and hence reduce the need for an additional power supply to supply the drive voltage.

In order to attain the aforementioned object, the present invention is also directed to a method of manufacturing a discharge head comprising a liquid chamber which accommodates a liquid to be discharged from a discharge hole onto a discharge receiving medium, and a piezoelectric body which applies a discharge pressure to the liquid inside the liquid chamber, the method comprising: a holding plate forming step of forming a holding plate to serve as a diaphragm; a holding plate side electrode forming step of forming a holding plate side electrode on at least one surface of the holding plate; a piezoelectric body forming step of forming the piezoelectric body on a surface of the holding plate side electrode on a side opposite to the holding plate; a liquid chamber side electrode forming step of forming a liquid chamber side electrode on a surface of the piezoelectric body on a side opposite to the holding plate side electrode; a flow channel layer forming step of forming a flow channel layer to define walls of the liquid chamber; and a discharge hole layer bonding step of bonding a discharge hole layer in which the discharge hole for discharging the liquid accommodated in the liquid chamber is provided, wherein at least one of the holding plate, the holding plate side electrode, the piezoelectric body and the liquid chamber side electrode is formed by aerosol deposition.

In other words, if the aerosol deposition method is used in the respective film forming steps, it is possible to form a laminated structure onto a surface having an undulating shape or a curved shape, for instance. In other words, the curved shapes of the respective layers can be formed readily.

Preferably, the holding plate forming step includes a curved shape forming step of bending the holding plate in a protruding shape toward the liquid chamber.

One curved shape may be formed in the holding plate, or a plurality of curved shapes may be formed therein.

In order to attain the aforementioned object, the present invention is also directed to a liquid discharging apparatus, comprising the above-described discharge head. According to the present invention, a liquid discharge apparatus suitable for high-viscosity liquid discharge and high-speed discharge can be achieved.

The liquid discharge apparatus may include an inkjet head recording apparatus which forms images by ejecting ink droplets onto a discharge receiving medium, known as a recording medium, or a dispenser which forms a three-dimensional shape of a medium by discharging (spraying) a liquid such as a chemical, processing liquid or water, onto an epoxy substrate, a glass substrate, a wafer, or the like.

According to the present invention, since the thickness of a thin film member including at least a first electrode provided on the surface of a piezoelectric body on a liquid chamber side is less than the combined thickness of a second electrode provided on the opposite side of the piezoelectric body to the liquid chamber and a holding plate, then when a prescribed drive voltage is applied to the piezoelectric body, the holding plate deforms in such a manner that it increases the volume of the liquid chamber. On the other hand, when the drive voltage applied between the first electrode and the second electrode is released during discharge of an ink droplet, the holding plate which has been deformed toward the outside of the liquid chamber acts so as to return to its original shape (namely, its shape when fixed in position). Therefore, the speed of deformation of the holding plate is increased, and liquid can be discharged with good efficiency. Furthermore, satisfactory discharge of high-viscosity liquid, and high-speed discharge, can be achieved.

Moreover, by bending the holding plate in a protruding shape toward the liquid chamber, the direction of displacement of the holding plate is not inverted. Therefore, variation in discharge characteristics between different discharge holes can be suppressed.

Furthermore, when layering an electrode layer, a piezoelectric layer, and the like, on a member having a curved shape, or the like (such as the holding plate, for example), the aerosol deposition method should be used which forms a thin film layer by depositing an aerosol (powdered material) sprayed from an aerosol nozzle onto the member.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
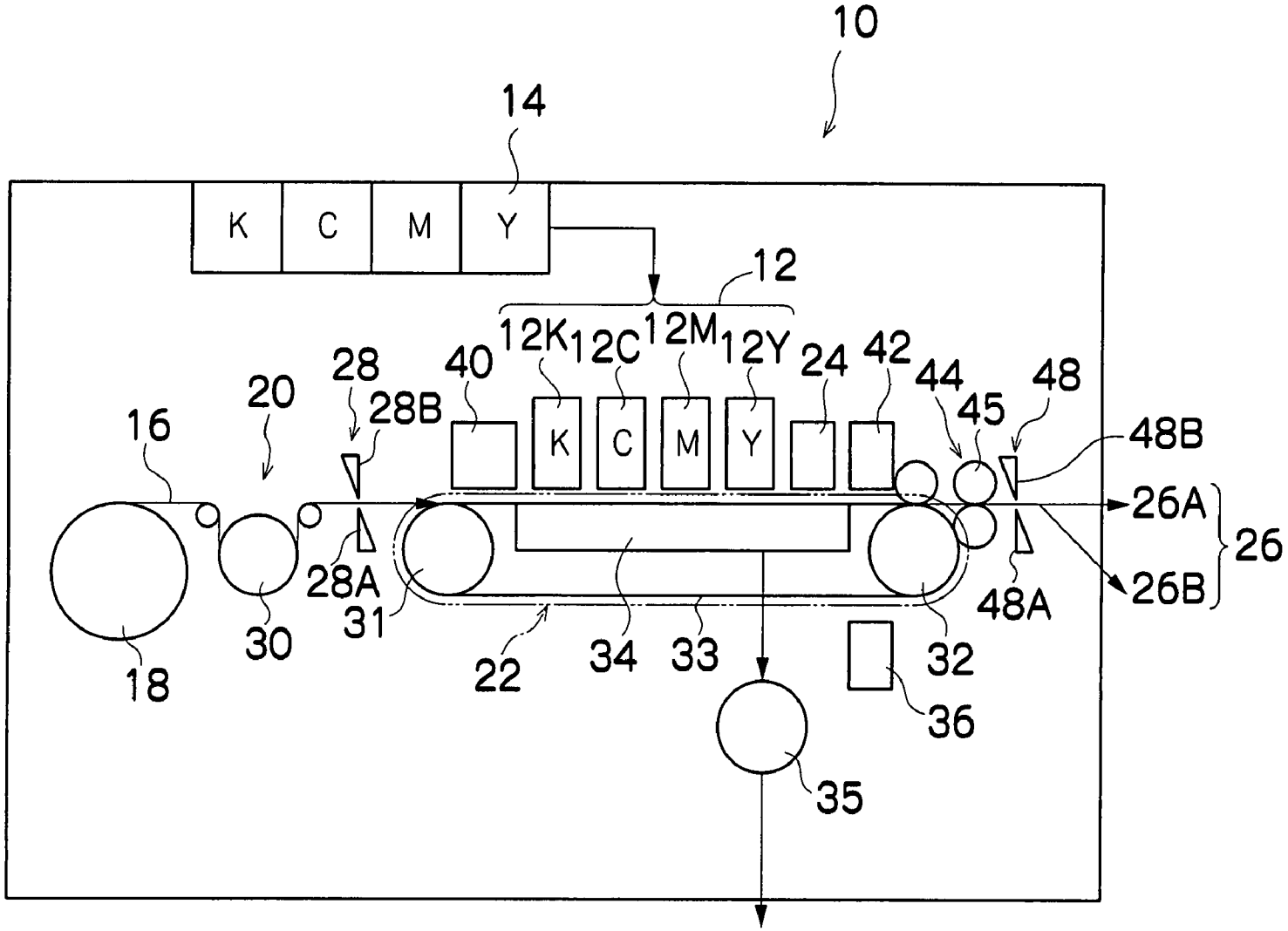
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In the present specification, the term "printing" expresses the concept of not only the formation of characters, but also the formation of images with a broad meaning that includes characters.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 5) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
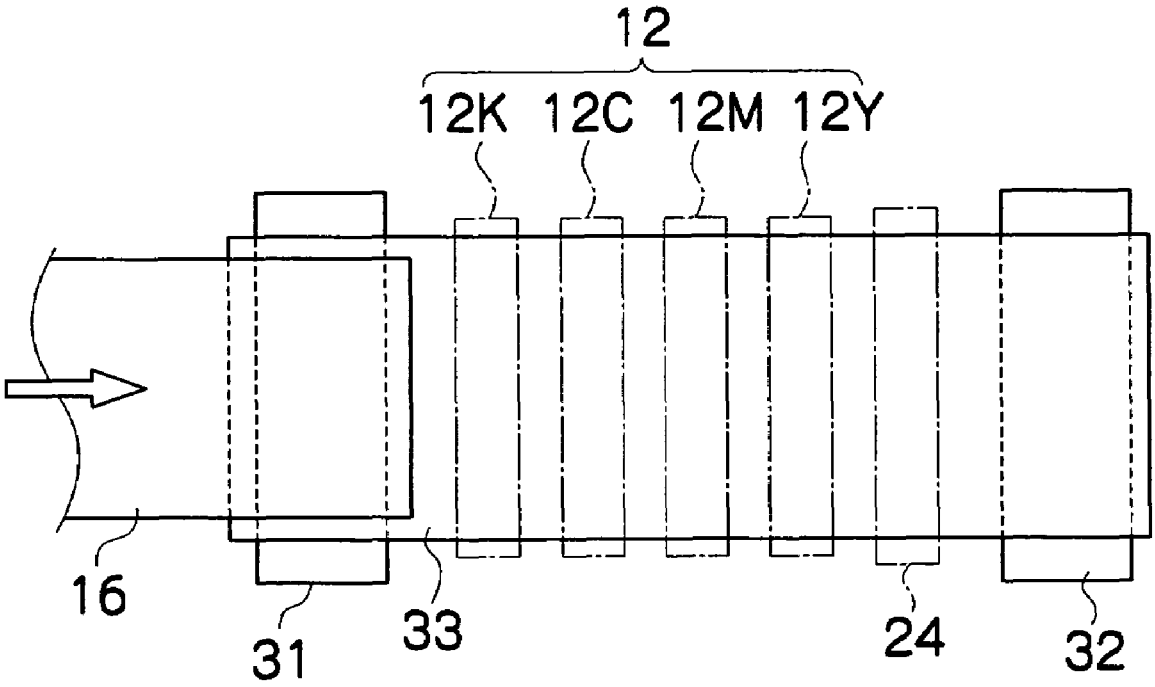
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 4. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. In addition, the order of arranging the print heads 12K, 12C, 12M, and 12Y is not limited to those.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined.

The ejection determination includes the presence of the ejection, measurement of the dot size, and measurement of the dot deposition position. The details of the ejection determination are described later.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
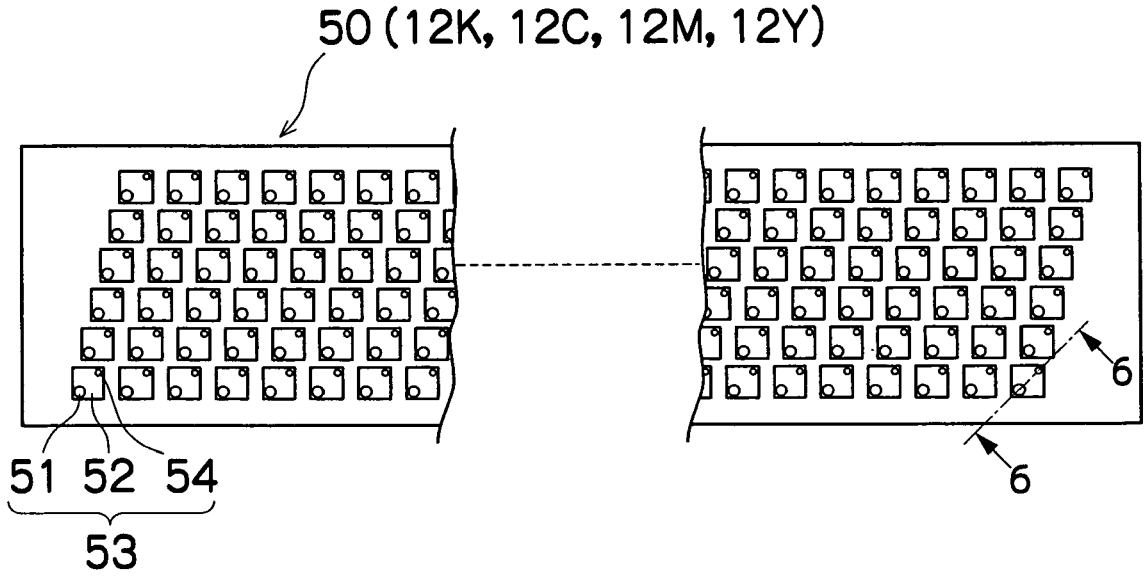
FIG. 3A is a perspective plan view showing an example of a configuration of a print head.
Figure 3B:
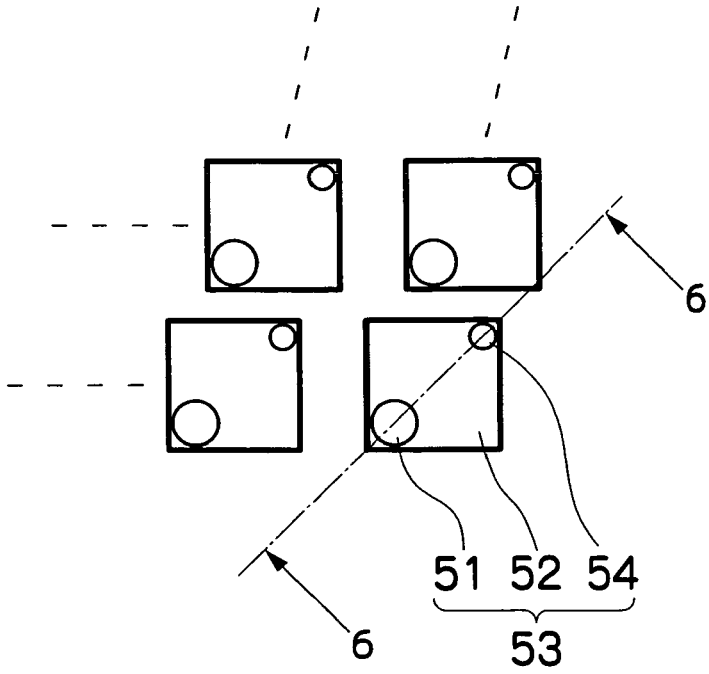
FIG. 3B is a partial enlarged view of FIG. 3A.
Figure 3C:
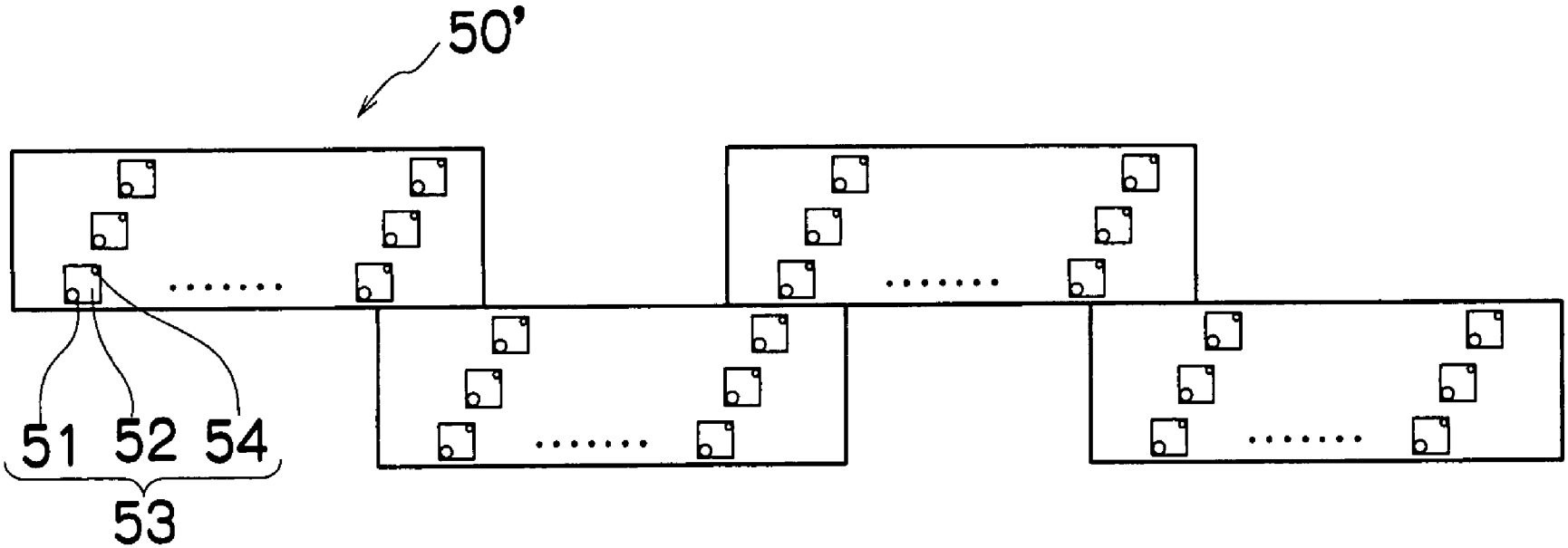
FIG. 3C is a perspective plan view showing another example of the configuration of the print head.

FIG. 3A is a perspective plan view showing an example of the configuration of the print head 50, FIG. 3B is an enlarged view of a portion thereof, and FIG. 3C is a perspective plan view showing another example of the configuration of the print head. The nozzle pitch in the print head 50 should be minimized in order to maximize the density of the dots printed on the surface of the recording paper. As shown in FIGS. 3A, 3B, and 3C, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

Figure 4:
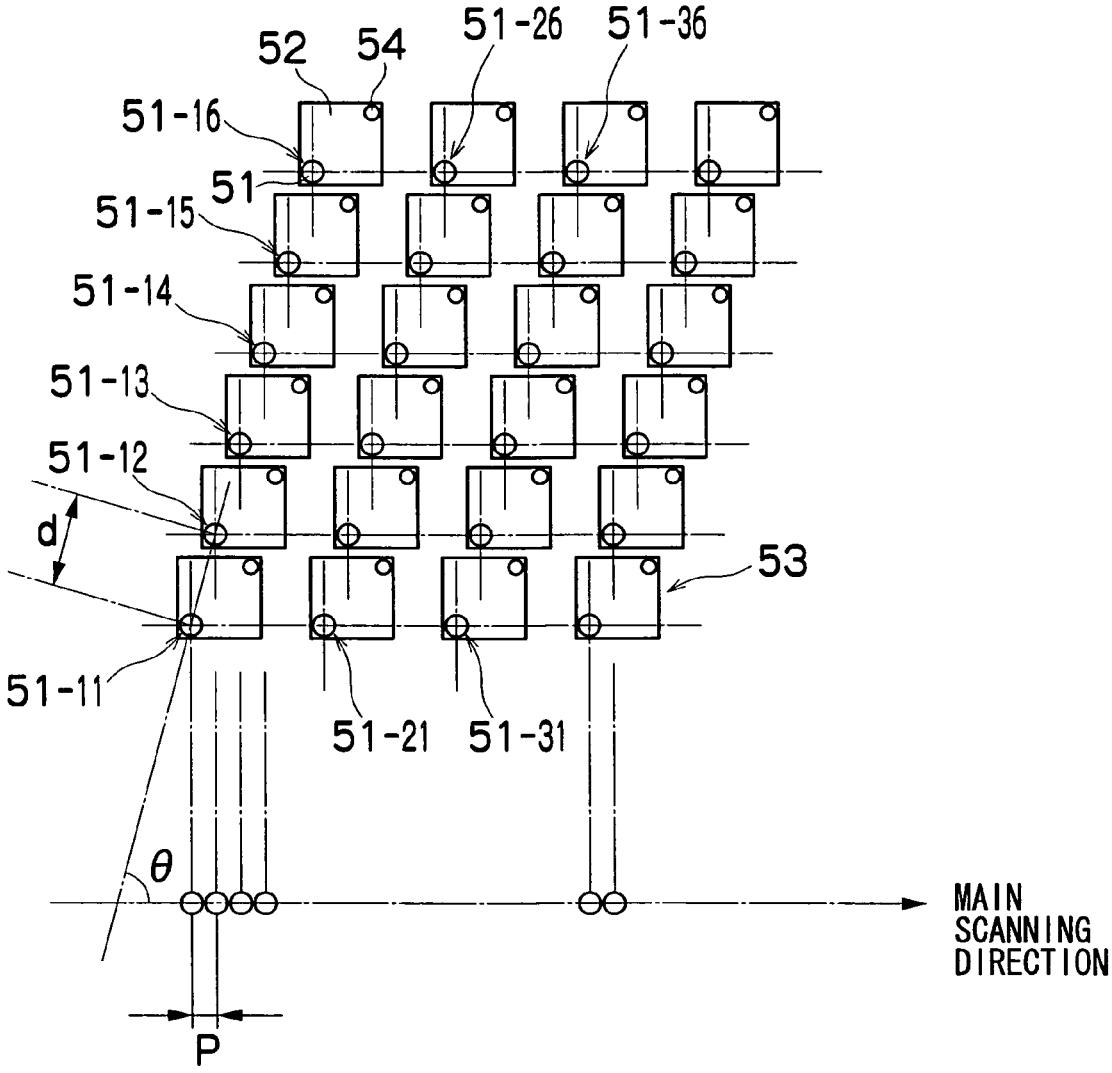
FIG. 4 is an enlarged view showing nozzle arrangement of the print head in FIG. 3A.

As shown in FIGS. 3A to 3C, the planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel (not shown) through the supply port 54.

As shown in FIG. 4, the nozzle 51 is connecting to the pressure chamber 52 through a nozzle channel 56. An actuator 59 having an individual electrode 58 is joined to a pressure plate 57, which forms the ceiling of the pressure chamber 52, and the actuator 59 is deformed by applying drive voltage to the individual electrode 58 to eject ink from the nozzle 51. When ink is ejected, new ink is delivered from the common flow channel 55 through the supply port 54 to the pressure chamber 52.

An actuator 108 (not shown in FIGS. 3A and 3B, but shown in FIG. 6) is joined to the ceiling of the pressure chamber 52. The actuator deforms by applying drive voltage to an individual electrode 104 (not shown in FIGS. 3A and 3B, but shown in FIG. 6) provided in the actuator, so as to discharge ink from the nozzle 51. When ink is discharged, new ink is delivered from the above-described common channel through the supply port 54 to the pressure chamber 52.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 4. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

Figure 5:
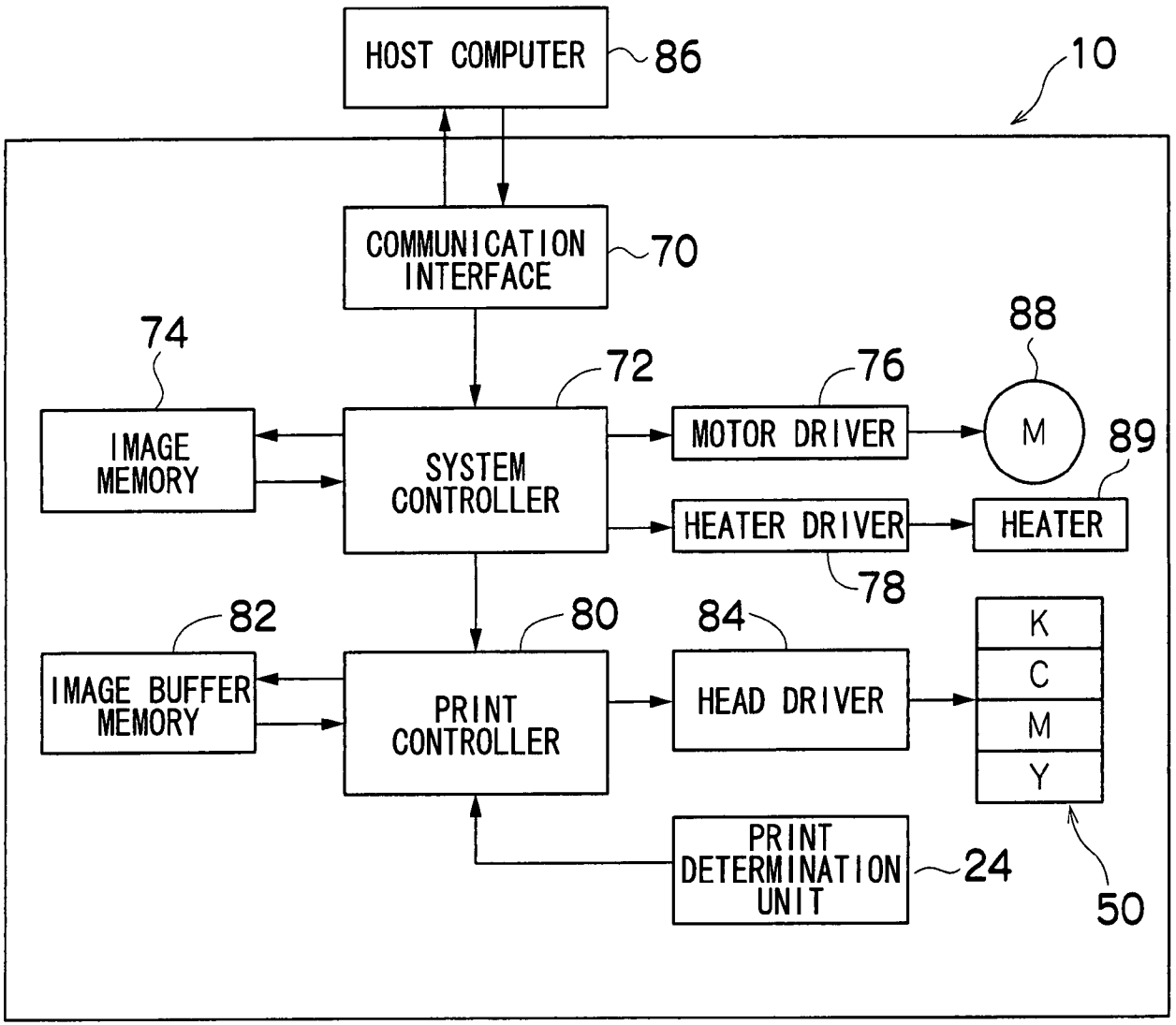
FIG. 5 is a principal block diagram showing the system composition of the inkjet recording apparatus.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

Therefore, "the main scanning direction" is the direction of one line (or the longitudinal direction of a band-shaped region) recorded by means of the aforementioned main scanning operation, and "the sub-scanning direction" is the direction in which the aforementioned sub-scanning operation. In other words, in the present embodiment, the direction of conveyance of the recording paper 16 is the sub-scanning direction and the direction orthogonal to this direction is the main scanning direction.

In implementing the present invention, the arrangement of the nozzles is not limited to that of the example illustrated. Moreover, a method is employed in the present embodiment where an ink droplet is ejected by means of the deformation of the actuator 59, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Although not shown in diagrams, the inkjet recording apparatus 10 is composed of an ink supply system included the ink storing and loading unit 14 described with reference to FIG. 1. The ink supply system comprises, an ink supply tank as a base tank for supplying ink, a filter, and the like.

The aspects of the ink supply tank include a refillable type and a cartridge type: when the remaining amount of ink is low, the ink supply tank of the refillable type is filled with ink through a filling port (not shown) and the ink supply tank of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

The filter for removing foreign matters and bubbles is disposed between the ink supply tank and the print head 50. The filter mesh size in the filter is preferably equivalent to or less than the diameter of the nozzle and commonly about 20 μm.

Furthermore, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap (not shown) as a device to prevent the nozzles 51 from drying out or to prevent an increase in the ink viscosity in the vicinity of the nozzles 51, and a cleaning blade (not shown) as a device to clean the nozzle face. A maintenance unit including the cap and the cleaning blade can be moved in a relative fashion with respect to the print head 50 by a movement mechanism (not shown), and is moved from a predetermined holding position to a maintenance position below the print head 50 as required.

The cap is displaced up and down in a relative fashion with respect to the print head 50 by an elevator mechanism (not shown). When the power of the inkjet recording apparatus 10 is switched OFF or when in a print standby state, the cap is raised to a predetermined elevated position so as to come into close contact with the print head 50, and the nozzle face is thereby covered with the cap.

The cleaning blade is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate 510 is wiped, and the surface of the nozzle plate is cleaned by sliding the cleaning blade on the nozzle plate.

During printing or standby, when the frequency of use of specific nozzles is reduced and ink viscosity increases in the vicinity of the nozzles, a preliminary discharge is made toward the cap to discharge the degraded ink.

Also, when bubbles have become intermixed in the ink inside the print head 50 (inside the pressure chamber), the cap is placed on the print head 50, ink (ink in which bubbles have become intermixed) inside the pressure chamber is removed by suction with a suction pump (not shown), and the suction-removed ink is sent to a collection tank (not shown). This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator is operated. Before reaching such a state the actuator is operated (in a viscosity range that allows discharge by the operation of the actuator), and the preliminary discharge is made toward the ink receptor to which the ink whose viscosity has increased in the vicinity of the nozzle is to be discharged. After the nozzle surface is cleaned by a wiper such as the cleaning blade provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 59 is operated. Also, when the ink viscosity inside the nozzle 51 has increased over a certain level, ink can no longer be discharged from the nozzle 51 even if the actuator 59 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

FIG. 5 is a block diagram of the principal components showing the system configuration of the inkjet recording apparatus 10. The inkjet recording apparatus 10 has a communication interface 70, a system controller 72, an image memory 74, a motor driver 76, a heater driver 78, a maintenance unit 79, a print controller 80, an image buffer memory 82, a head driver (voltage applying device) 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 5 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

Various control programs are stored in a program storage section (not illustrated), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also be combined with a storage device for storing operational parameters, and the like (not illustrated).

The print determination unit 24 is a block including a line sensor as shown in FIG. 1, which reads in the image printed onto the recording paper 16, performs various signal processing operations, and the like, and determines the print situation (presence/absence of discharge, variation in droplet ejection, etc.), these determination results being supplied to the print controller 80.

Furthermore, according to requirements, the print controller 80 makes various corrections with respect to the print head 50 on the basis of information obtained from the print determination unit 24.

In the example shown in FIG. 1, the print determination unit 24 is provided on the print surface side, the print surface is irradiated with a light source (not illustrated), such as a cold cathode fluorescent tube disposed in the vicinity of the line sensor, and the reflected light is read in by the line sensor. However, in implementing the present invention, another composition may be adopted.

Structure of Ink Chambers

Next, the structure of an ink chamber provided in the print head 50 will be described in detail.

Figure 6:
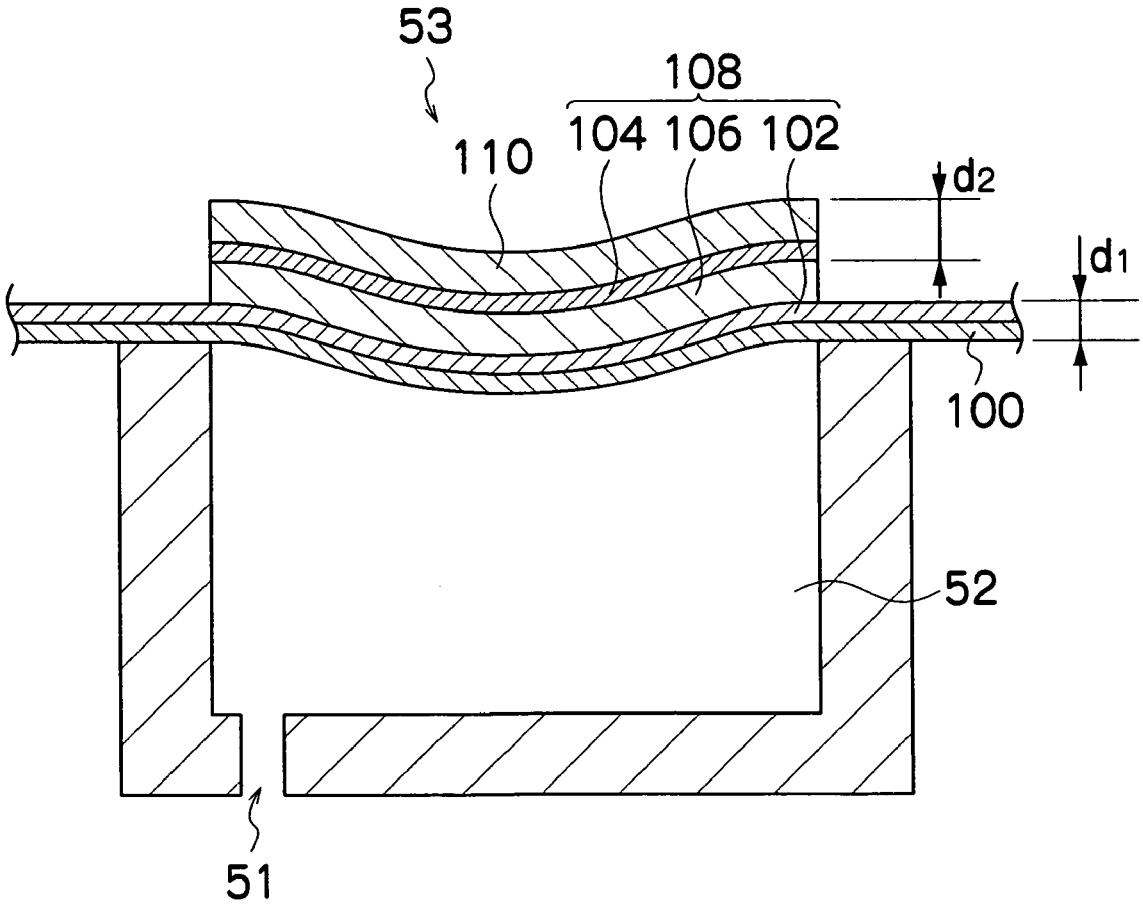
FIG. 6 is a cross-sectional diagram along line 6-6 in FIGS. 3A and 3B, showing the three-dimensional structure of an ink chamber unit provided in a print unit according to the present embodiment.

FIG. 6 is a cross-sectional diagram (along line 6-6 in FIGS. 3A and 3B) showing the three-dimensional structure of an ink chamber unit 53.

As shown in FIG. 6, the ink chamber unit 53 comprises a pressure chamber 52 which accommodates ink to be discharged from a nozzle 51, a pressure chamber side holding plate 100 forming the ceiling of the pressure chamber 52, an actuator 108 formed on the pressure chamber side holding plate 100 on the opposite side to the pressure chamber 52, the actuator 108 comprising a piezoelectric body 106 sandwiched between a lower electrode 102 and an upper electrode 104, and an upper electrode side holding plate 110 formed on the actuator 108, on the opposite side to the piezoelectric body. In FIG. 6, the supply port 54 shown in FIG. 4 is not depicted, in order to simplify the drawings.

Furthermore, as shown in FIG. 6, the pressure chamber side holding plate 100 forming the ceiling of the pressure chamber 52 has a protruding shape toward the pressure chamber 52, and the actuator 108 and the upper electrode side holding plate 110 formed on top of the pressure chamber side holding plate 100 also have a protruding shape toward the pressure chamber 52, in accordance with the shape of the pressure chamber side holding plate 100.

The pressure chamber side holding plate 100 functions as a protective layer for the lower electrode 102 in order that the ink inside the pressure chamber 52 does not make contact with the lower electrode 102, and it also serves to support the lower electrode 102. A member having insulating properties, such as silicon, glass epoxy, or the like, is used for the pressure chamber side holding plate 100.

The lower electrode 102 and the upper electrode 104 are made from a metal material having high electrical conductivity which can be formed into a thin plate (thin film), such as gold, silver, copper or platinum. The lower electrode 102 and upper electrode 104 are patterned onto the upper surface and lower surface of the piezoelectric body 106 by means of photolithographic etching, or another technique.

A lead zirconate titanate ($Pb(Zr, Ti)O_3$) (PZT) piezoelectric ceramic is used for the piezoelectric body 106 which is formed so as to be sandwiched between the lower electrode 102 and the upper electrode 104. Of course, it is also possible to use a piezoelectric body made of another material, such as barium titanate ($BaTiO_3$).

One of the lower electrode 102 and the upper electrode 104 forms an individual electrode, and the other forms a common electrode. In the example shown in FIG. 6, the lower electrode 102 is a common electrode which is connected to the common electrodes of the other actuators. The upper electrode 104 is an individual electrode, which applies a drive signal to the respective actuator. Desirably, the common electrode is earthed to the device (in other words, it functions as an earth mechanism).

Figure 7:
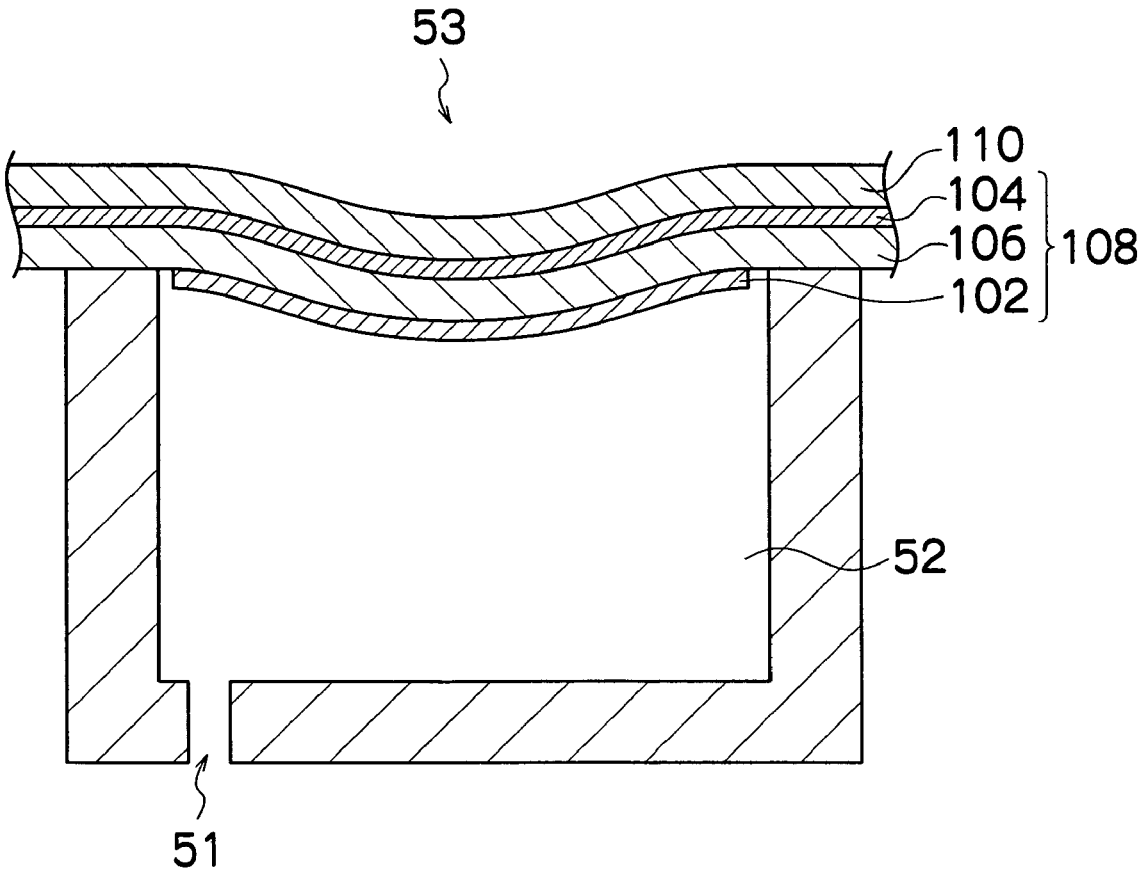
FIG. 7 is a diagram showing a further mode of the ink chamber unit illustrated in FIG. 6.

It should be noted that, as illustrated in FIG. 7, it is also possible to adopt a structure in which the lower electrode 102 is used as an individual electrode, the upper electrode 104 is used as a common electrode, and the pressure chamber side holding plate 100 is omitted. If the pressure chamber side holding plate 100 is omitted, then the lower electrode 102 forming the individual electrode is subjected to ink resistance treatment and insulation treatment in the portion of the electrode which makes contact with the ink. If the upper electrode 104 is used as a common electrode, then a common upper electrode side holding plate 110 may be formed for adjacently position ink chamber units. Moreover, a split electrode type of composition may also be adopted, in which a common piezoelectric body 106 is formed for a plurality of adjacent ink chamber units.

Here, a piezoelectric body generating $d_{31}$ mode displacement is used for the piezoelectric body 106. In other words, the piezoelectric body 106 generates a distortion in a direction that is substantially perpendicular to the direction in which the voltage is applied (the direction of the acting electrical field), namely, the lateral direction of the piezoelectric body. If a member functioning as a diaphragm plate (pressurization plate) is provided on the upper surface or lower surface of a $d_{31}$ mode piezoelectric body (namely, on the surface where the individual electrode or the common electrode is formed), then the diaphragm plate can be caused to deform in the vertical direction (a direction substantially parallel to the electrical field), as a result of the distortion of the piezoelectric body in the lateral direction (a direction substantially perpendicular to the electrical field).

Furthermore, as shown in FIG. 6, the upper electrode side holding plate 110 formed on the upper portion of the actuator 108 deforms in accordance with the displacement of the actuator 108 (piezoelectric body 106), and it therefore functions as a diaphragm which applies a discharge pressure to the ink inside the pressure chamber 52. A material such as silicon is used mainly to form the upper electrode side holding plate 110. It is of course possible to use a thin metal plate of SUS (stainless steel), aluminum alloy, or the like, for the upper electrode side holding plate 110.

In the ink chamber unit 53, the combined thickness, d1, of the pressure chamber side holding plate 100 and the lower electrode 102 is less than the combined thickness, d2, of the upper electrode 104 and the upper electrode side holding plate 110. In other words, the upper surface side of the piezoelectric body 106 (the side opposite to the pressure chamber) is formed to a greater thickness than the lower surface side thereof (the pressure chamber side).

In other words, taking the thickness of the electrodes for driving the piezoelectric body 106 to include the plates (members) which support those electrodes, the following relationship (1) is established between the combined thickness, d1, of the pressure chamber side electrode (in other words, the lower electrode 102) and the plate holding the pressure chamber side electrode (in other words, the pressure chamber side holding plate 100), and the combined thickness, d2, of the electrode on the side opposite to the pressure chamber (in other words, the upper electrode 104), and the electrode holding plate on the side opposite to the pressure chamber:

$$d1 < d2. \quad (1)$$

Figure 8:
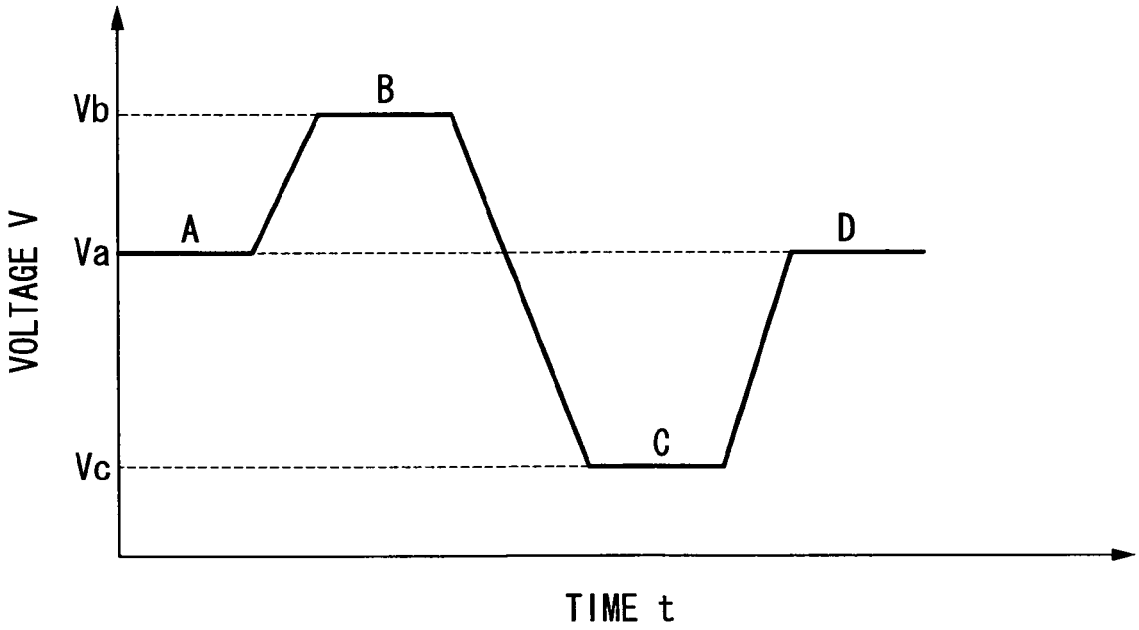
FIG. 8 is a diagram showing the drive voltage waveform of an actuator provided in the ink chamber unit illustrated in FIGS. 6 and 7.
Figure 9A:
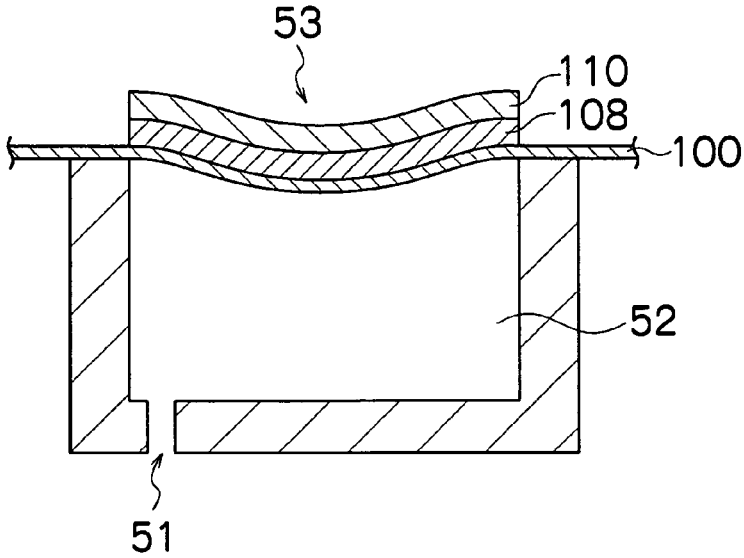
FIGS. 9A to 9C are diagrams showing change in the ink chamber unit illustrated in FIG. 6 when a drive voltage is applied as illustrated in FIG. 8.
Figure 9B:
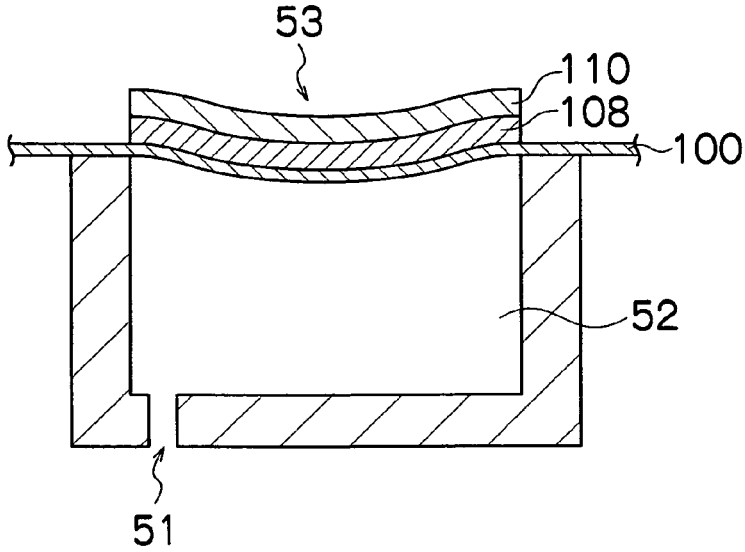
Figure 9C:
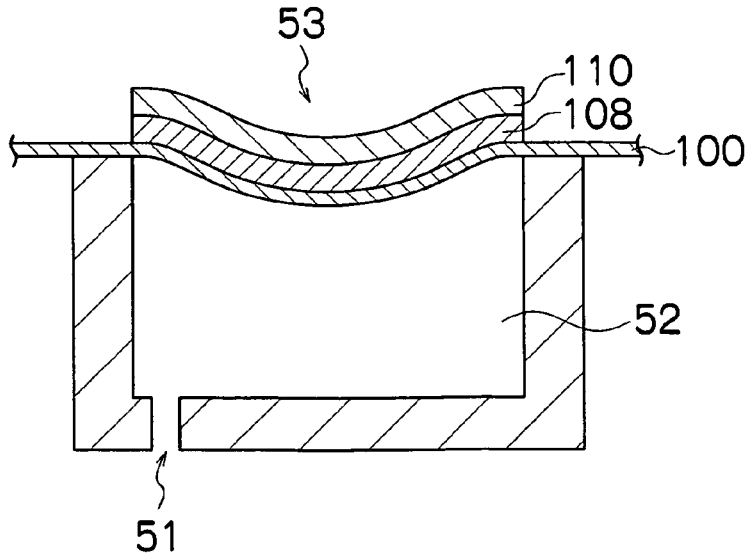

When a positive drive voltage is applied to the actuator 108 provided in the ink chamber unit 53 having the composition described above, as illustrated in FIG. 8, the ceiling of the ink chamber unit 53 (the upper electrode side holding plate 110 forming the diaphragm, hereafter called the diaphragm 110) can be deformed as illustrated in FIGS. 9A to 9C.

More specifically, in order to maintain the actuator 108 in the state illustrated in FIG. 9A, the applied voltage Va (securing voltage) for standby illustrated in FIG. 8 is applied to the individual electrode of the actuator 108 (state A). Next, when the meniscus is pulled back as illustrated in FIG. 9B, the applied voltage Vb for pulling (pull-in voltage) illustrated in FIG. 8 is applied, and the diaphragm 110 is deformed toward the opposite side of the ink chamber (state B). By means of this operation, the diaphragm 110 is deformed in such a manner that the volume of the pressure chamber 52 is increased, and ink is supplied to the pressure chamber 52 from the supply port (not illustrated). Here, during discharge as illustrated in FIG. 9C, an applied voltage Vc for pushing (discharge voltage) as illustrated in FIG. 8 is applied to the actuator 108, and an ink droplet is discharged from the nozzle 51 (state C). When an ink droplet has been discharged from the nozzle 51, the application voltage for standby, Va, illustrated in FIG. 8 is applied to the actuator 108, and the diaphragm 110 returns to the state illustrated in FIG. 9A (state D).

Figure 10:
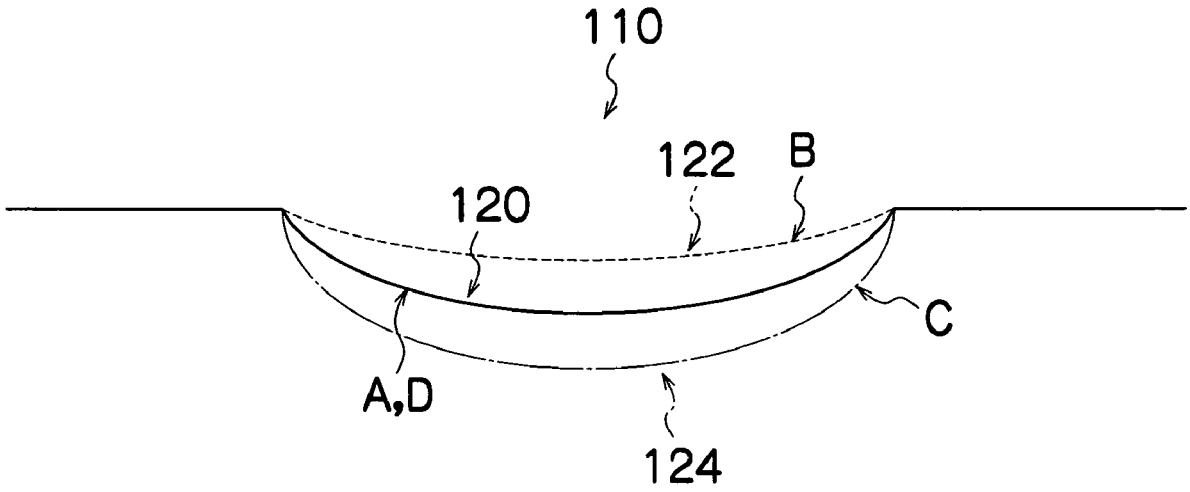
FIG. 10 is a diagram showing change in the diaphragm illustrated in FIG. 6 when a drive voltage is applied as illustrated in FIG. 8.

FIG. 10 shows the state of deformation of the diaphragm 110 as observed from the side, when a drive signal (voltage) as illustrated in FIG. 8 is applied to the actuator 108. As shown in FIG. 10, the applied voltage for standby, Va, illustrated in FIG. 8 is applied during a standby status of the discharge operation (states A and D), and in this state, the diaphragm 110 has the shape indicated by the solid line 120 when observed in side view. Furthermore, during a pull operation (state B), the diaphragm 110 is deformed toward the opposite side to the pressure chamber, and it assumes the shape indicated by the broken line 122, when observed in side view. Moreover, during a push operation (during discharge, state C), the diaphragm 110 is deformed toward the pressure chamber and assumes the shape indicated by the single-dot broken line 124, when observed in side view.

The relationship between the applied voltage during standby, Va, the applied voltage during a pull operation, Vb, and the applied voltage during a push operation, Vc, is as follows:

$$|Vc| < |Va| < |Vb|. \quad (2)$$

This indicates that the applied voltage during discharge (applied voltage during a push operation), Vc, is lower than the applied voltage during standby, Va, and the applied voltage during a pull operation, Vb. Furthermore, it also shows that the applied voltage during standby Va is lower than the applied voltage Vb during a pull operation.

Here, the direction of polarity of the piezoelectric element (piezoelectric body) used in the actuator 108 will be described.

Figure 11A:
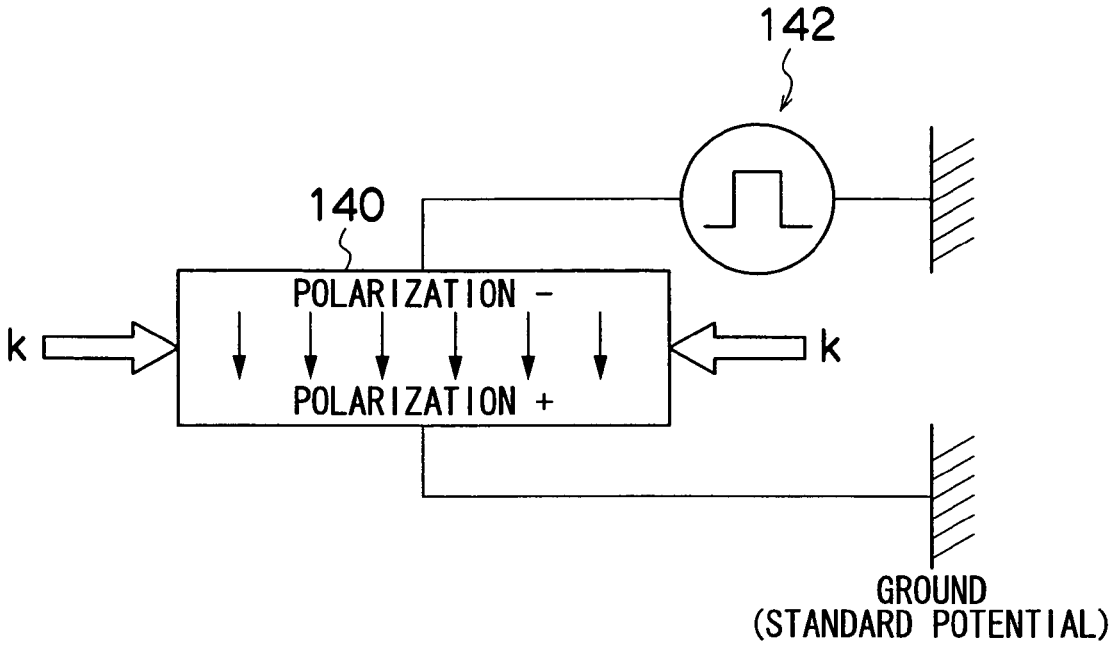
FIGS. 11A and 11B are diagrams illustrating the polarity of a piezoelectric element.
Figure 11B:
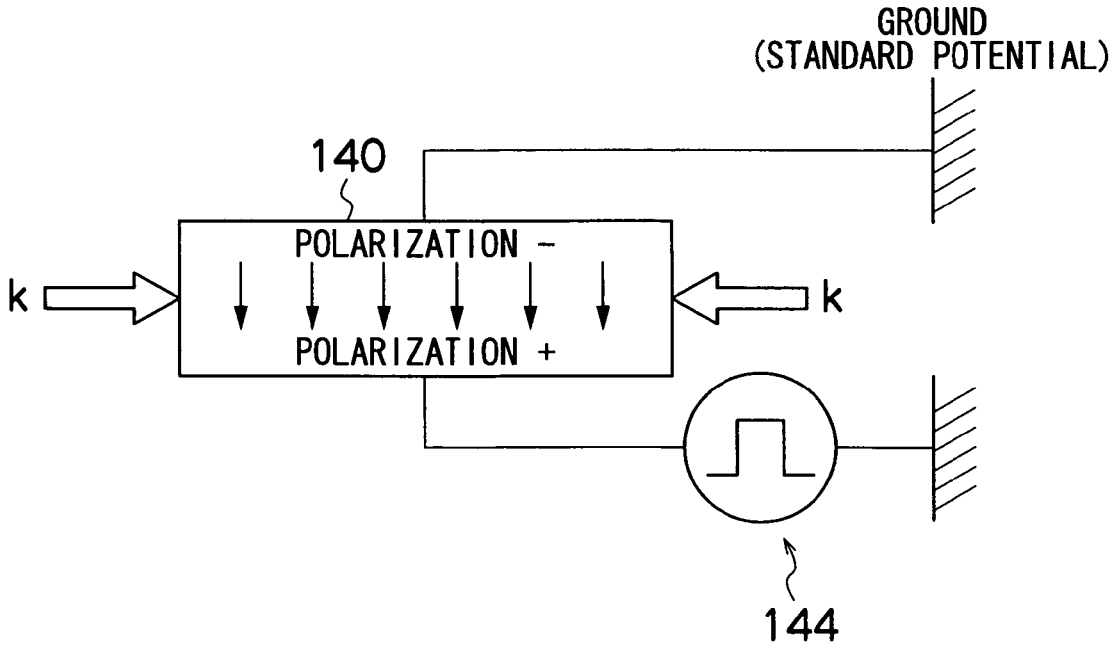

FIGS. 11A and 11B are diagrams showing the direction of polarity of the piezoelectric element 140, and the direction of distortion of the piezoelectric element 140 in accordance with the voltage applied to it.

FIG. 11A shows a state where the positive polarity side (+) assumes the earth potential (standard potential) of the applied voltage. The direction of the arrows in the piezoelectric body 140 show the direction of polarization of the piezoelectric element 140.

As shown in FIG. 11A, when a positive voltage 142 is applied to the negative polarity side (−), then the piezoelectric body 140 contracts in the lateral direction (the direction indicated by arrows k), due to the $d_{31}$ effect.

In other words, the driving of the actuator 108 shown in FIGS. 6 to 10 controls the contraction of the actuator 108 by applying a positive voltage as illustrated in FIG. 8 to the negative polarity side of the actuator 108.

In the state shown in FIG. 11B, on the other hand, the negative polarity side assumes the earth level of the drive voltage, and when a negative voltage 144 is applied to the positive polarity side, the piezoelectric element contracts in the lateral direction (the direction of arrows k) due to the $d_{31}$ effect.

Figure 12:
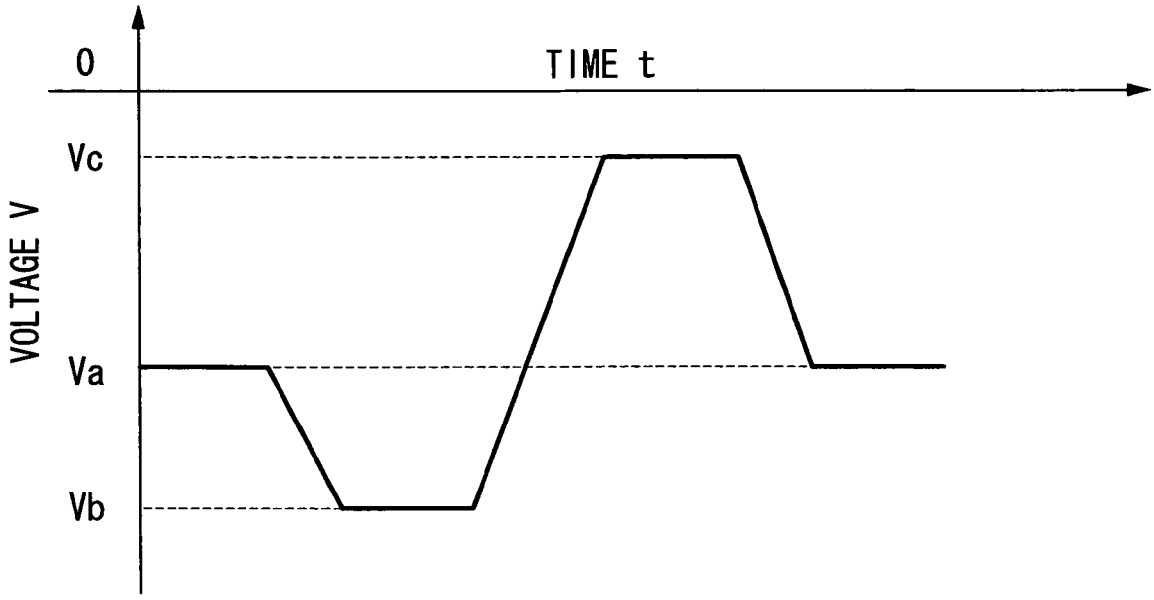
FIG. 12 is a diagram showing a further mode of the drive voltage illustrated in FIG. 8.

In the state shown in FIG. 11B, if the negative voltage shown in FIG. 12 is applied to the positive polarity side, then it is possible to control the contraction of the actuator 108, similarly to the case where a positive voltage as illustrated in FIG. 8 is applied in the state in FIG. 11A.

In the state shown in FIG. 11A, if a negative voltage is applied to the negative polarity side, then the piezoelectric element 140 moves so as to extend in the lateral direction (the direction opposite to the arrows k). Similarly, in the state shown in FIG. 11B, if a positive voltage is applied to the positive polarity side, then the piezoelectric element 140 moves so as to extend in the lateral direction (the direction opposite to the arrows k).

Figure 13:
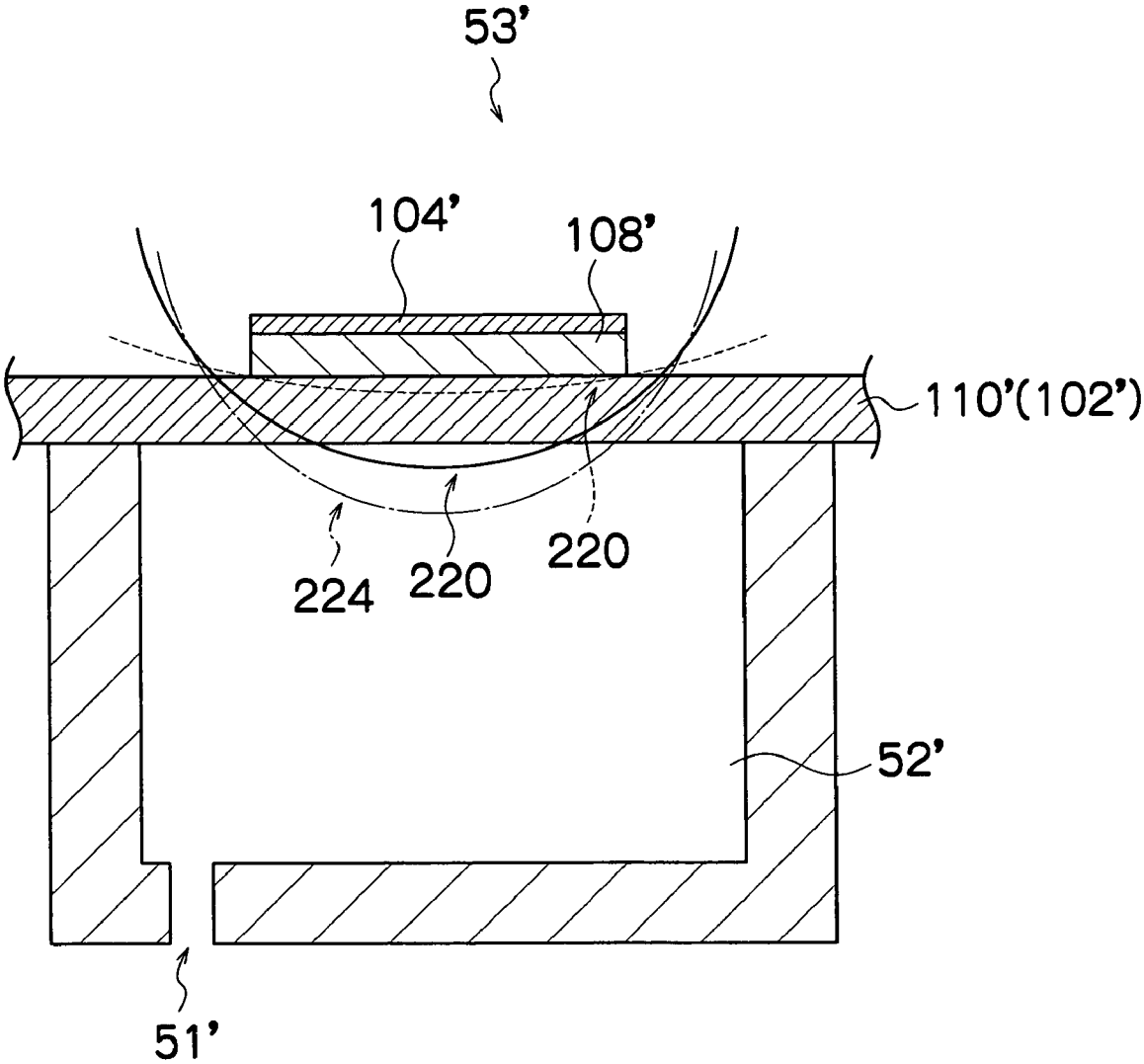
FIG. 13 is a diagram showing the structure of an ink chamber unit provided in a conventional print head, and the change in the diaphragm upon application of a drive voltage.
Figure 14:
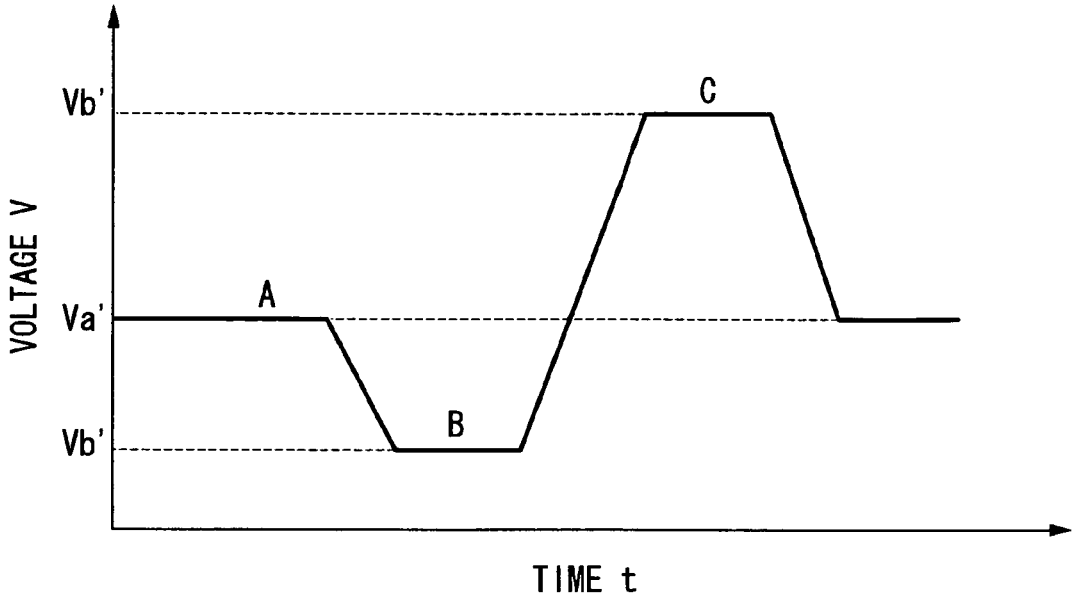
FIG. 14 is a diagram showing the drive voltage waveform of an actuator relating to the prior art.

On the other hand, FIG. 13 is a cross-sectional diagram showing the three-dimensional structure of an ink chamber unit 53' relating to the prior art (corresponding to FIGS. 6 and 7). FIG. 14 is a drive signal applied to the actuator 108' when discharging the ink droplets from the ink chamber unit having the structure illustrated in FIG. 13.

The ink chamber unit 53' shown in FIG. 13 has an actuator 108' provided on a diaphragm 110' forming the ceiling of a pressure chamber 52', and the actuator 108' applies a discharge pressure for discharging ink inside the pressure chamber 52' from a nozzle 51' by causing the diaphragm 110' to deform. An upper electrode 104' is provided on the opposite side of the actuator 108' with respect to the diaphragm 110'. A lower electrode 102' also serves as the diaphragm 110'.

The relationship between the applied voltage during standby, Va', the applied voltage during a pull operation, Vb', and the applied voltage during a push operation, Vc', in the drive signal illustrated in FIG. 14 is indicated by the following expression:

$$|Vb'|<|Va'|<|Vc'|. \quad (3)$$

Furthermore, similarly to FIG. 10, FIG. 13 shows the shape of the diaphragm 110', as observed in side view, when the drive signal illustrated in FIG. 14 is applied. At standby (states A and D in FIG. 14), a certain voltage Va' is applied and the diaphragm 110' is displaced in such a manner that it reduces the volume of the pressure chamber 52', as indicated by the solid line 220. Furthermore, during a pull operation (state B in FIG. 14), a lower voltage Vb' is applied than during standby, and the diaphragm 110' is displaced toward the opposite side to the pressure chamber 52' (namely, in such a manner that it temporarily increases the volume of the pressure chamber 52'), as indicated by the broken line 222. Moreover, during a push operation (in other words, during discharge, or state C in FIG. 14), a voltage Vc' that is higher than the voltage during standby, Va', is applied and the diaphragm 110' is displaced toward the pressure chamber as indicated by the single-dotted broken line 224.

In the ink chamber unit 53 of the print head relating to the present invention as illustrated in FIG. 10, during a discharge operation (during a push operation), the change in the actuator 108 (diaphragm 110) caused by change in the drive voltage (drive signal) coincides with the direction which returns the actuator 108 to its initial state. In other words, an ink discharge is performed when the voltage applied to the actuator 108 changes from a high voltage to a low voltage, (in other words, when the electrical charge is released).

By deforming a diaphragm 110 by driving the actuator 108 in this way, the forces of the deformed actuator 108 and diaphragm 110 which seek to return them to their original state can be used as an ink discharge force. Therefore, the actuator 108 and the diaphragm 110 are made to move smoothly, and loss of discharge energy can be reduced.

In the ink chamber unit 53' of the print head relating to the prior art as illustrated in FIG. 13, the change in the actuator 108' caused by change in the drive voltage of the actuator 108' is the reverse of the direction which returns the actuator 108' to its initial state. In other words, ink is discharged when the voltage applied to the actuator 110' changes from a low voltage to a high voltage.

In other words, in the ink chamber unit 53 of the print head 50 relating to the present invention, the direction of displacement of the actuator when electrical energy is applied to the actuator 108 is the same as the direction of the mechanical restoring force of the actuator 108 (and the diaphragm 110), and therefore, the discharge energy applied to the ink during discharge is equivalent to sum of these energies. This is beneficial for discharging high-viscosity liquids which require a larger discharge energy.

Figure 15:
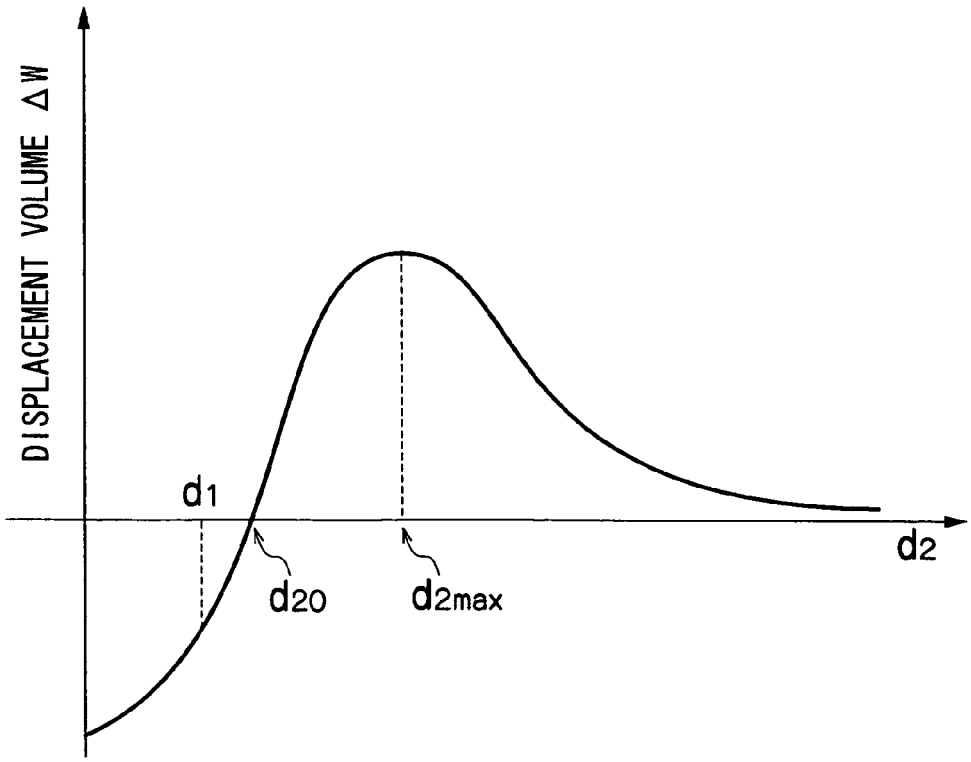
FIG. 15 is a diagram showing the relationship between the distance d2 shown in FIG. 6 and the change in the volume of the ink chamber unit.

FIG. 15 is a graph showing change in the displacement volume ΔW of the pressure chamber 52 when the combined thickness, d2, of the upper electrode 104 and the diaphragm (upper electrode side holding plate) 110 is increased.

This graph indicates the direction of distortion when a contracting piezoelectric body (indicated by reference symbol 106 in FIG. 6 and other diagrams), is bonded with non-contracting plate-shaped members (namely, the pressure chamber side holding plate 100, the lower electrode 102, the upper electrode 104 and the diaphragm 110 in FIG. 6). More specifically, this diagram shows a bimetal effect indicating the side to which the actuator 108 is distorted when the piezoelectric body 106 is deformed or contracted.

According to FIG. 15, if the thickness on the upper side of the actuator 108 is the same as the thickness d1 on the lower side (in other words, if d1=d2), then the actuator 108 is displaced towards the inner side of the pressure chamber 52, thereby reducing the volume of the pressure chamber 52. If d2 is increased from this state, then at d2=d20, the ink chamber unit reaches a state where the volume of the pressure chamber 52 does not change (in other words, the actuator 108 is not displaced), even if a prescribed drive signal is applied to the actuator 108. If d2 is increased further and reaches d2=d2max, the volume change in the pressure chamber 52 reaches a maximum, and any further increase in the value of d2 will tend to cause the volume change in the pressure chamber 52 to decline gradually.

Therefore, in order to discharge the largest amount of ink from the pressure chamber 52 in a single driving action of the actuator 108, the upper electrode 104 and the diaphragm 110 should be formed in such a manner that d2=d2max. In practice, the thickness of the diaphragm 110 is substantially larger than the thickness of the upper electrode, and therefore the thickness of the diaphragm 110 is increased in order to raise the value of d2. (In other words, the rigidity of the diaphragm 110 is increased).

The present embodiment was described with respect to a mode where the constituent members of the ceiling of the pressure chamber, such as a the diaphragm 110, are formed in a protruding shape toward the pressure chamber. However, in the present invention, the constituent members of the ceiling of the pressure chamber may have a planar shape, as illustrated in FIGS. 16A and 16B.

Figure 16A:
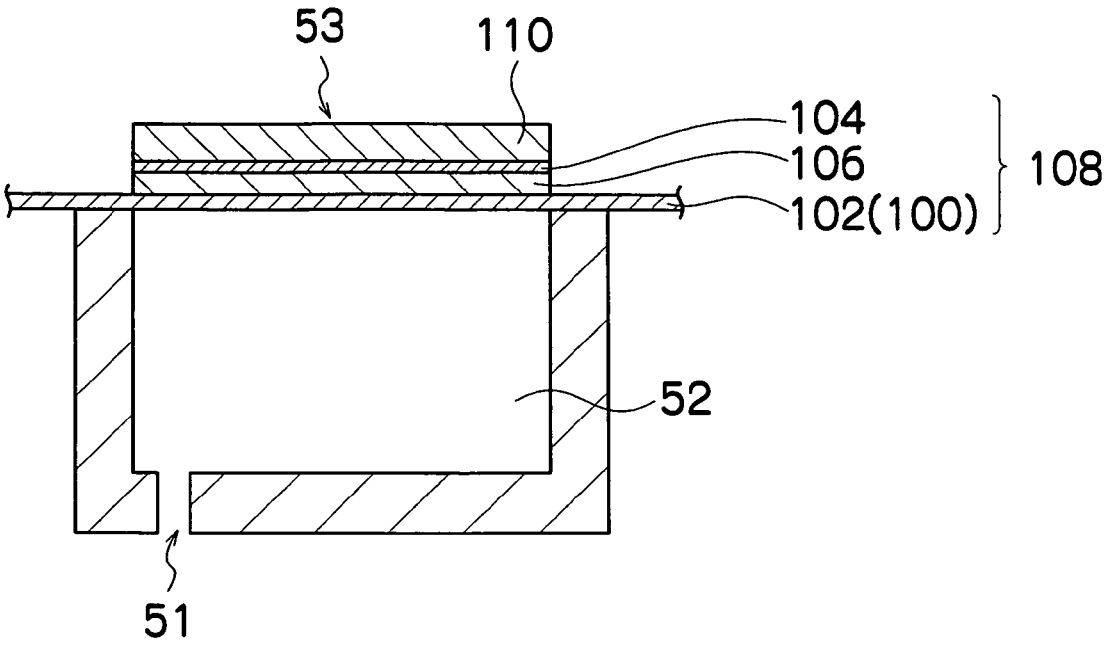
FIGS. 16A and 16B are diagrams showing a further mode of the ink chamber unit illustrated in FIG. 6.
Figure 16B:
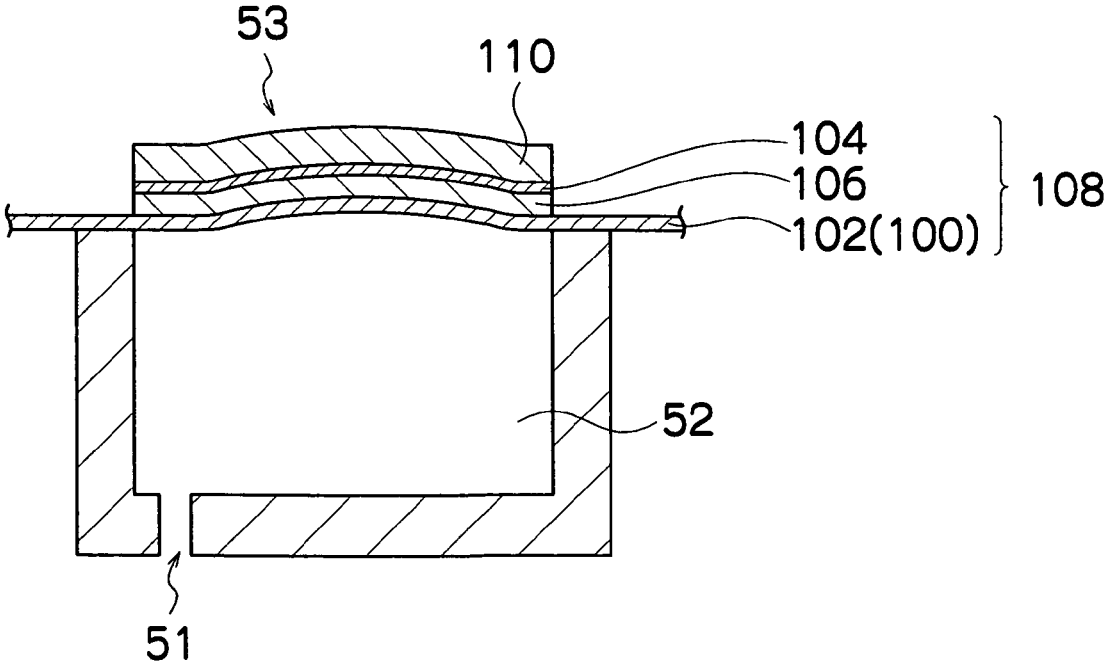

FIG. 16A shows a state where the drive voltage is off, and FIG. 16B shows a state where the drive voltage is on.

Figure 17:
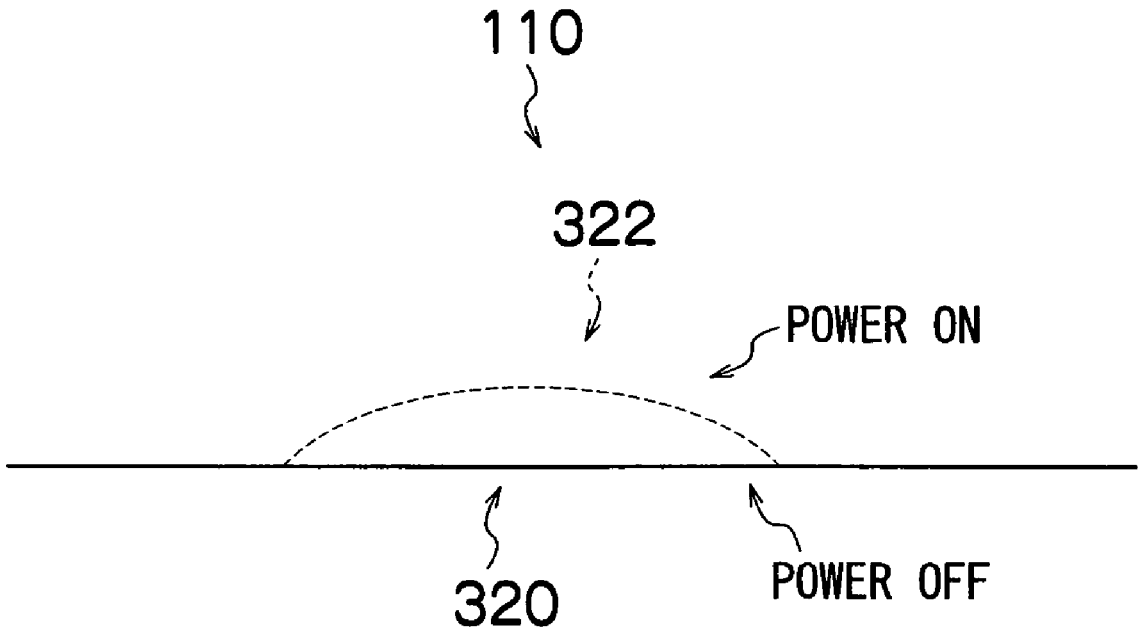
FIG. 17 is a diagram showing change in the diaphragm illustrated in FIG. 16 when a drive voltage is applied as illustrated in FIG. 8.

Furthermore, if the deformation of the diaphragm 110 caused by the switching on and off of the drive voltage is as shown in FIG. 17, then when the drive voltage is off (corresponding to a standby state, A, in FIG. 8), the diaphragm 110 does not protrude at all toward the pressure chamber side or the side opposite to the pressure chamber, as indicated by reference numeral 320 in FIG. 17.

On the other hand, if the drive voltage is on (corresponding to a pull operation B in FIG. 8), then a positive voltage is applied, with respect to the period when the drive voltage is off and the diaphragm 110 deforms in such a manner that it protrudes toward the outer side of the pressure chamber 52, as indicated by reference numeral 322 in FIG. 17.

When ink is discharged from this state, the drive voltage is switched off (or a negative voltage is applied with respect to the voltage when the drive voltage is off), and the diaphragm 110 deforms from the shape protruding toward the outside of the pressure chamber 52 indicated by reference numeral 322, toward the inner side of the pressure chamber 52. This is the same as the action performed when a diaphragm 110, that has been deformed in a protruding shape toward to the outside of the pressure chamber 52, reverts to its original shape.

Figure 18A:
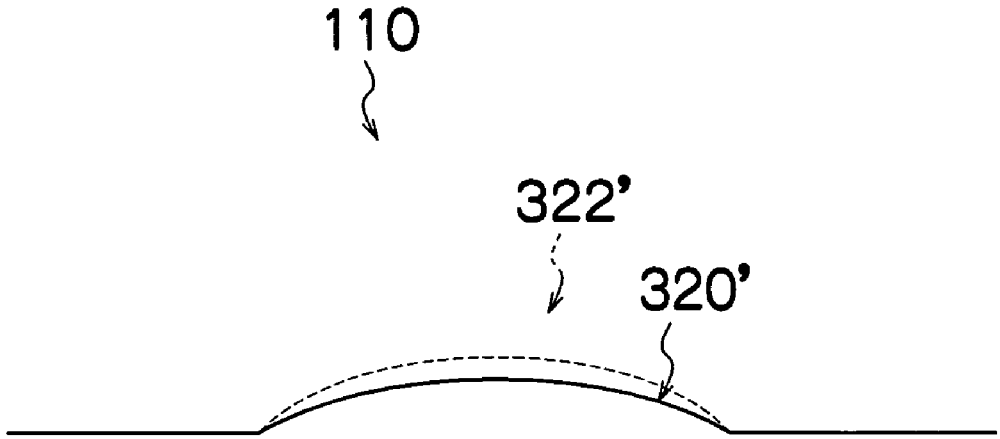
FIGS. 18A and 18B are diagrams showing the direction of change of the diaphragm due to variation in the diaphragm illustrated in FIGS. 16A and 16B.
Figure 18B:
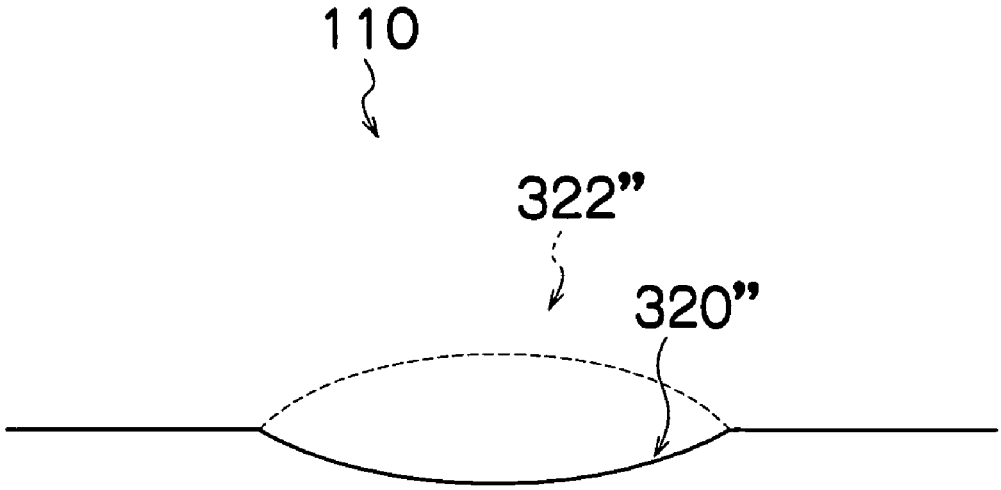

A flat diaphragm 110 which does not protrude toward the outer side or inner side of the pressure chamber 52 shown in FIG. 17 may in fact have a protruding shape toward the outside of the pressure chamber 52 within a prescribed range as indicated by reference numeral 320' in FIG. 18A, or it may have a protruding shape toward the inner side of the pressure chamber 52 within a prescribed range as indicated by reference numeral 320" in FIG. 18B. This is caused by individual variations in the diaphragm 110 or other members, (namely, variations in processing, or deformation during the manufacturing process).

In the state shown in FIG. 18B, the diaphragm 110 protrudes toward the inner side of the pressure chamber 52, and when a drive voltage is applied, it deforms toward the outer side of the pressure chamber 52. Therefore, the direction of distortion of the actuator 108 during operation (in other words, the direction of deformation of the diaphragm 110) is inverted, and hence variations in nozzle characteristics will occur between the states illustrated respectively in FIGS. 18A and 18B.

In a print head 50 having the foregoing composition, a diaphragm 110 is provided on the opposite side of the actuator 108 to the pressure chamber 52, and the combined thickness of the diaphragm 110 and the upper electrode 104 is designed to be greater than the combined thickness of the pressure chamber side holding plate 100 and the lower electrode 102, d1 (in other words, d1<d2). Therefore, the deformation of the actuator 108 when a drive voltage (Vc) is applied during discharge, and the deformation of the actuator 108 when it reverts to its initial state, occur in the same direction. Consequently, the speed of deformation of the actuator 108 is accelerated and high-viscosity discharge and high-speed discharge can be achieved. Furthermore, it is also possible to suppress loss of the discharge energy applied by the actuator 108 to the ink that is to be discharged.

Moreover, by forming the members constituting the ceiling of the pressure chamber 52, including the actuator 108, so as to have a protruding shape toward the inside of the pressure chamber 52, the direction of distortion of the actuator 108 is always the same direction, and hence the operation of the actuator 108 and the diaphragm 110 is stabilized.

Furthermore, since the diaphragm 110 does not make direct contact with the ink, then it is not required to have ink resistant properties, or the like, and hence the range of selection of the material used for the diaphragm 110 is increased.

Method of Manufacturing Ink Chamber Unit

Below, a method of forming films by means of the aerosol deposition method, as used to manufacture the ink chamber unit 53 of the print head 50 relating to the present invention, will be described.

The ink chamber unit 53 has a structure in which a plurality of thin plate shaped members are layered together as shown in FIG. 6 and other drawings.

In other words, in the ink chamber unit 53 shown in FIG. 6, a metal thin film layer of Au, Cu, or the like, constituting the lower electrode 102 is formed on the pressure chamber side holding plate 100 constituting the ceiling of the ink chamber unit, and furthermore, a piezoelectric layer forming the piezoelectric body 106 is formed on top of the lower electrode 102. Moreover, a structure is adopted in which a metal thin film layer of Au, Cu, or the like constituting an upper electrode 104 is formed on the piezoelectric body 106, and an upper electrode side holding plate layer for forming the diaphragm 110 is formed on thereon.

The aforementioned laminated structure may be formed by bonding together thin plate (thin film) shaped members of the respective layers, by means of adhesive, or the like (in a bonding step using a bonding device).

However, it is difficult to bond the other plate-shaped members accurately onto a curved plate-shaped member (a plate-shaped member having an undulating shape), such as the diaphragm 106 illustrated in FIG. 6. Furthermore, peeling apart and bonding errors between the respective layers may occur due to insufficient bonding strength or insufficiently close contact.

In order to resolve problems of this kind, in the ink chamber unit 53 of the print head 50 relating to the present invention, the aerosol deposition method which forms a film by spraying particles called an aerosol onto a film receiving member, is used at least in the piezoelectric layer forming step for forming the piezoelectric body 106.

Of course, the aerosol deposition method may also be used in the steps of forming metal thin film layers to constitute the upper electrode 104 and the lower electrode 102, a pressure chamber layer to constitute pressure chamber walls, a flow channel layer comprising ink flow channels, and the like. The aerosol deposition method may also be used to form the whole of the print head 50 (pressure chamber unit 53).

Figure 19:
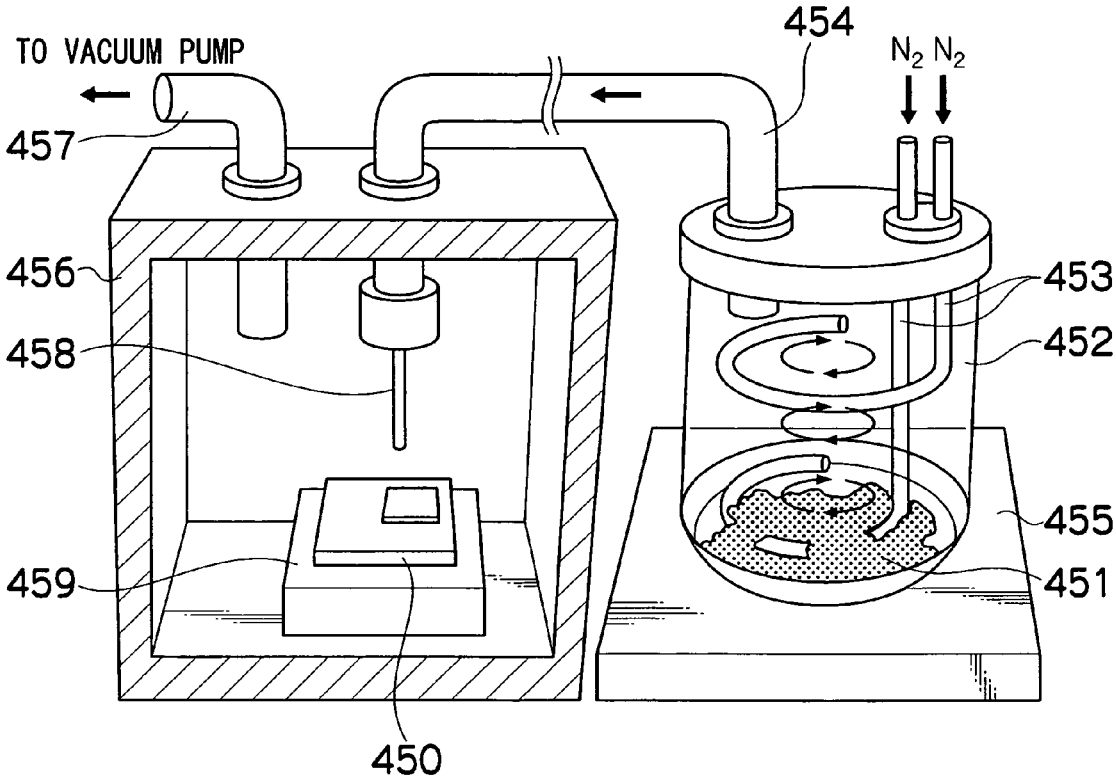
FIG. 19 is a schematic drawing showing a film formation device based on the aerosol deposition method.

FIG. 19 is a schematic drawing showing a film formation device based on the aerosol deposition method. This film formation device has an aerosol generating chamber 452 which accommodates a raw material powder 451. Here, an "aerosol" refers to fine particles of a solid or liquid which are suspended in a gas.

A carrier gas input section 453, an aerosol output section 454, and a vibrating unit 455 are attached to the aerosol generating chamber 452. An aerosol is generated by introducing a gas, such as nitrogen gas, via the carrier gas input section 453 and thus blowing and lifting the raw material powder that is accommodated in the aerosol generating chamber 452. In this case, by applying a vibration to the aerosol generating chamber 452 by means of the vibrating unit 455, the raw material powder is churned up and an aerosol is generated efficiently. The aerosol thus created is channeled through the aerosol output section 454 to a film formation chamber 456.

An exhaust tube 457, a nozzle 458 and a movable stage 459 are provided at the film formation chamber 456. The exhaust tube 457 is connected to a vacuum pump and evacuates the interior of the film formation chamber 456. The aerosol generated in the aerosol generating chamber 452 and conducted to the film formation chamber 456 via the aerosol output section 454 is sprayed from the nozzle 458 onto a substrate 450. In this way, the raw material powder collides with and builds up on the substrate 450. The substrate 450 is mounted on a movable stage 459 that is capable of three-dimensional movement, and hence the relative positions of the substrate 450 and the nozzle 458 can be adjusted by controlling the movable stage 459.

Next, the steps of forming the respective layers relating to the manufacture of the print head 50 (the ink chamber unit 53) are described with reference to FIGS. 20A to 20F.

Figure 20A:
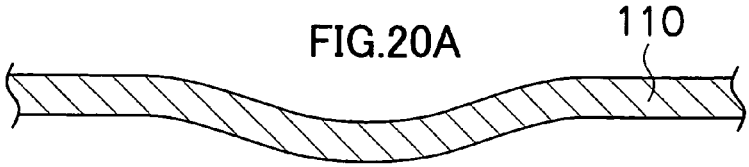
FIGS. 20A to 20F are diagrams showing steps for manufacturing a print head relating to the present invention.

FIG. 20A shows a cross-sectional view of a diaphragm 110 formed by a diaphragm forming step (pressure chamber side holding plate forming step). An electrically conductive resin is used for the diaphragm 110. Naturally, it is also possible to use stainless steel (SUS300), or glass, or an oxide ceramic such as $SiO_2$, $Al_2O_3$, or the like. Furthermore, the curved shape of the diaphragm 110 is formed by pressing. Of course, it is also possible to form a curved shape by means of another method, such as cutting or etching, and it is also possible to combine two or more types of technique in such a manner that the member is finished by cutting or grinding after performing rough processing by means of a press.

Figure 20B:
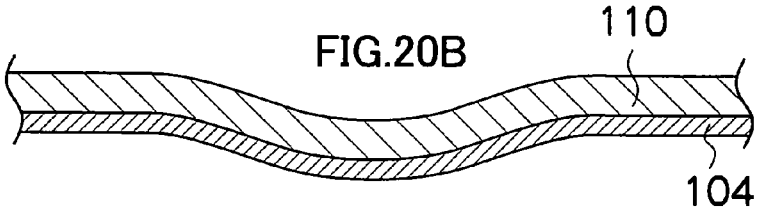

Moreover, FIG. 20B shows a diaphragm 110 on which an upper electrode 104 is formed by means of an upper electrode forming step. The upper electrode 104 is formed by means of sputtering, or the like, on the lower surface of the diaphragm 110 formed by the diaphragm forming step illustrated in FIG. 20A.

A metal thin plate of Au, Cu or Pt is used for the upper electrode 104 formed by the lower electrode forming step. If the upper electrode 104 is used as an individual electrode, then an insulating layer is formed between the diaphragm 110 and the upper electrode 104.

Figure 20C:
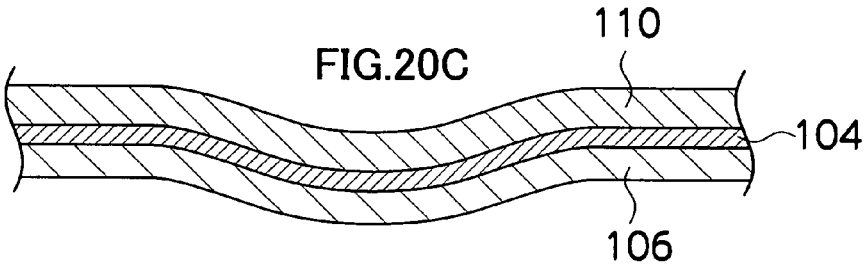

FIG. 20C shows a diaphragm 110, in which a piezoelectric body 106 is formed on the upper electrode 104, on the opposite side to the diaphragm 110, by means of a piezoelectric body forming step (PZT forming step). The aerosol deposition method described above is used in this piezoelectric body forming step.

Figure 20D:
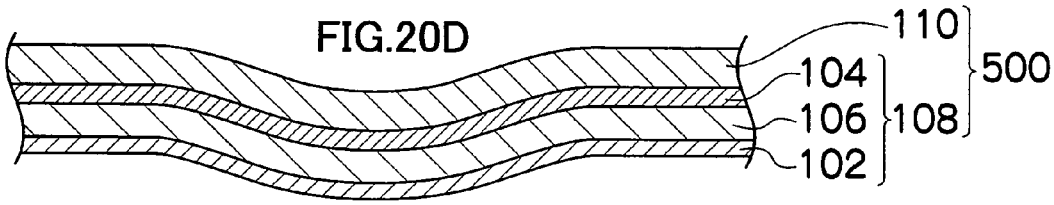

Furthermore, FIG. 20D shows a diaphragm 110 in which a lower electrode 102 is formed on the piezoelectric body 106, on the opposite side to the upper electrode 104. It is possible to use the same material as the upper electrode 104 for the lower electrode 102, or it is possible to use a differential material.

Figure 20E:
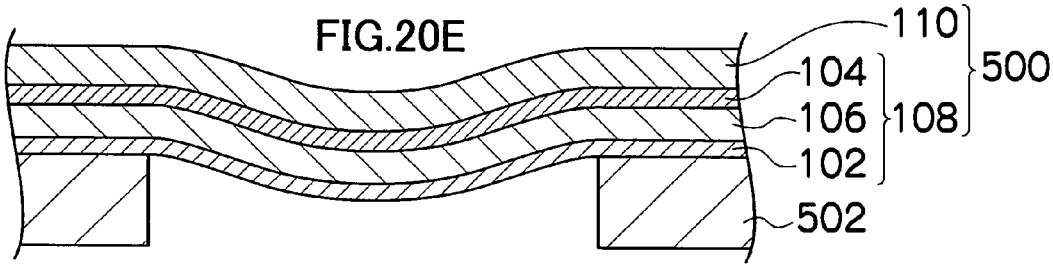

Here, FIG. 20E shows a state where a ceiling member 500 of the pressure chamber 52 comprising the diaphragm 110, and the like, formed by means of the steps illustrated in FIGS. 20A to 20D, has been bonded to a pressure chamber plate (flow channel plate) 502 by means of an adhesive, or the like.

Figure 20F:
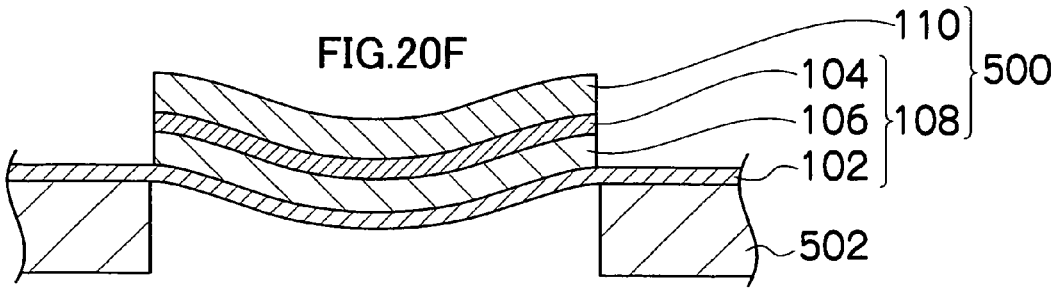

FIG. 20F shows a state where the unwanted portions of the ceiling member 500 have been removed by etching, or the like. An ink chamber unit 53 is formed by means of the nozzle plate attachment step for attaching a nozzle plate formed with nozzles 51 to the pressure chamber formed as described above, and a wiring step for forming wiring to the lower electrode 102 and an upper electrode 104.

The steps illustrated in FIGS. 20A to 20F are the minimum steps necessary to manufacture an ink chamber unit 53, and in addition to these steps, it is also possible to include a heat treatment step (annealing step), a resist patterning step, and the like.

In the present embodiment, the aerosol deposition method is used for the piezoelectric body forming step in the manufacture of a print head 50 (ink chamber unit 53), but it is also possible to use the aerosol deposition method instead of the aforementioned methods in the other steps.

In the method of manufacturing a print head 50 having the composition described above, the aerosol deposition method is used at least in the piezoelectric body forming step, and therefore a curved piezoelectric body 106 can be formed on a curved diaphragm 110.

In the present embodiment, a print head used in an inkjet recording apparatus was described as an example of a liquid droplet discharge head, but the present invention may also be applied to a discharge head used in a liquid discharge apparatus which forms images, or shapes, such as circuit wiring or machining patterns, by discharging a liquid (such as water, a chemical solution, resist, or processing liquid) onto a discharge receiving medium, such as a wafer, glass substrate, epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A discharge apparatus, comprising:

a liquid chamber which accommodates a liquid to be discharged from a discharge hole onto a discharge receiving medium;

an actuator formed on the liquid chamber comprising a piezoelectric body, a thin film member, and a second electrode;

the piezoelectric body acts in a $d_{31}$ mode which applies a discharge pressure to the liquid inside the liquid chamber;

the thin film member which includes a first electrode provided at least on a surface of the piezoelectric body on a side facing the liquid chamber;

the second electrode which is provided on a surface of the piezoelectric body on a side opposite to the liquid chamber;

a holding plate which is bonded to a surface of the second electrode on a side opposite to the piezoelectric body, wherein a thickness of the thin film member is less than a sum of a thickness of the second electrode and a thickness of the holding plate; and a drive unit applying a discharge voltage to the actuator having an absolute value of the discharge voltage applied between the first electrode and the second electrode of the actuator during the liquid discharge operation, the change in the actuator caused by change in the discharge voltage coincides with the direction which returns the actuator to its initial state when the liquid accommodated in the liquid chamber is discharged by driving the piezoelectric body that is less than the drive unit applying a securing voltage to the actuator having an absolute value of the securing voltage applied between the first electrode and the second electrode of the actuator when the holding plate is secured in position during non-discharge of the liquid accommodated in the liquid chamber and the liquid is discharged by the drive unit applying a pull-in voltage between the first electrode and the second electrode of the actuator to expand the liquid chamber from a state in which the securing voltage is applied between the first electrode and the second electrode of the actuator by the drive unit and then the drive unit applying the discharge voltage between the first electrode and the second electrode of the actuator to reduce the liquid chamber.

2. The discharge apparatusas defined in claim 1, wherein an absolute value of a pull-in voltage applied between the first electrode and the second electrode when driving the piezoelectric body so as to cause the holding plate to deform toward an outside of the liquid chamber is greater than the absolute value of the securing voltage.

3. The discharge apparatusas defined in claim 1, wherein when no voltage is applied between the first electrode and the second electrode, the holding plate is curved in a protruding shape toward an inside of the liquid chamber.

* * * * *